US008313263B2

(12) United States Patent
Gueret

(10) Patent No.: US 8,313,263 B2
(45) Date of Patent: Nov. 20, 2012

(54) DEVICE FOR PACKAGING AND APPLYING A SUBSTANCE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 12/656,640

(22) Filed: Feb. 5, 2010

(65) Prior Publication Data

US 2010/0147322 A1 Jun. 17, 2010

Related U.S. Application Data

(62) Division of application No. 11/100,374, filed on Apr. 7, 2005, now Pat. No. 7,686,528.

(60) Provisional application No. 60/566,413, filed on Apr. 30, 2004.

(30) Foreign Application Priority Data

Apr. 9, 2004 (FR) ..... 04 50727

(51) Int. Cl.
*A46B 11/00* (2006.01)

(52) U.S. Cl. ..... 401/129; 401/4

(58) Field of Classification Search ..... 401/118, 401/121, 122, 126–130, 4
See application file for complete search history.

(56) References Cited

U.S. PATENT DOCUMENTS

| | | | | |
|---|---|---|---|---|
| 2,904,808 | A | 9/1959 | Massman | |
| 3,085,281 | A | 4/1963 | Massman | |
| 3,209,387 | A | 10/1965 | Lukesch | |
| 3,311,941 | A * | 4/1967 | Buchwalter et al. | 401/4 |
| 3,456,923 | A | 7/1969 | Zeuzem | |
| 4,984,918 | A * | 1/1991 | Iizuka et al. | 401/4 |
| 5,192,153 | A | 3/1993 | Gueret | |
| 6,568,405 | B2 * | 5/2003 | Masuyama | 132/218 |
| 7,172,357 | B2 * | 2/2007 | Gueret | 401/129 |
| 2002/0003983 | A1 | 1/2002 | Gueret | |
| 2002/0005209 | A1 | 1/2002 | Gueret | |
| 2002/0007839 | A1 | 1/2002 | Gueret | |
| 2003/0063945 | A1 | 4/2003 | Gueret | |

FOREIGN PATENT DOCUMENTS

| | | |
|---|---|---|
| DE | 31 00 529 A1 | 8/1982 |
| EP | 0 465 278 A1 | 1/1992 |
| EP | 1 177 741 A1 | 2/2002 |
| EP | 1 419 712 A1 | 5/2004 |
| FR | 1.374.719 A | 10/1964 |

* cited by examiner

*Primary Examiner* — Huyen Le

(74) *Attorney, Agent, or Firm* — Oliff & Berridge, PLC

(57) ABSTRACT

The present invention provides a device for packaging and applying a substance, the device comprising: a receptacle for containing the substance, the receptacle comprising: a first part and a second part, the second part being turnable by the user relative to the first part; and an applicator; the second part defining at least one surface in contact with the substance inside the receptacle, the applicator and said surface being arranged in such a manner that turning said surface exerts pressure on the substance, causing the substance to move towards the applicator, the first part defining a backing surface, and said surface being capable of coming at least in part to face said backing surface at the end of turning the second part.

35 Claims, 22 Drawing Sheets

DEVICE FOR PACKAGING AND APPLYING A SUBSTANCE

CROSS-REFERENCE TO RELATED APPLICATION

This application is a divisional of U.S. patent application Ser. No. 11/100,374 which is a non-provisional application that claims the benefit of U.S. Provisional Application No. 60/566,413 filed on Apr. 30, 2004. The disclosure of the prior application is incorporated herein by reference in its entirety.

BACKGROUND

The present invention relates to devices for packaging and applying a substance, in particular a cosmetic or a care product.

German patent application DE 31 00529 A1 describes a device for packaging and dispensing a cream, the device comprising two portions that can turn relative to each other, and a chamber containing the cream, which chamber is formed inside the device, with turning of one of the parts relative to the other causing the volume of said chamber to decrease and the cream to be dispensed directly via an outlet orifice. That device does not have an applicator device.

U.S. Pat. No. 3,085,281 discloses a receptacle for nail varnish including a bladed stirrer that can be rotated by the user using a knurled wheel at the bottom of the receptacle.

European patent application EP 1 177 741-A1 describes a receptacle including a stirrer that can be driven in rotation by the stem of the applicator.

French patent FR 1 374 719 describes a similar receptacle.

US patent application No. 2002/0007839 describes a packaging and applicator device having a piston engaged on a screw that is turned by the user. The pressure exerted on the substance is due to the piston moving axially, which piston needs to be prevented from turning relative to the body of the receptacle in order to be capable of being driven by the screw.

Packaging and applicator devices for mascara are also known that comprise an applicator comprising a brush mounted at the end of a stem whose other end is secured to a closure capsule for the receptacle that also constitutes a handle. The receptacle is generally elongate in shape and relatively narrow, so that the brush can extract most of the substance that is contained in the receptacle. With such a device, a certain quantity of substance is nevertheless never extracted by the brush and becomes lost after a chimney has been formed in the substance.

SUMMARY

There exists a need in particular:

to modify the appearance of devices for packaging and applying a substance and including an applicator;

to make such devices easy to carry about in a handbag;

to create a new technique for loading the applicator with substance on each use;

where appropriate, to make more uniform the substance contained in the device for extracting the applicator or for feeding to the applicator, which is advantageous in particular for substances comprising a plurality of immiscible phases, e.g. two or even three or more different phases;

to modify the texture of the substance and also its rheology, where necessary, in particular for thixotropic substances;

to make it easier to load the applicator with a predefined quantity of substance on each use;

to ensure that the substance is of the same quality on each use;

to enable the quantity of substance that is loaded onto the applicator to be controlled, where appropriate;

to enable at least one characteristic of the substance, such as for example its color, its covering power, its brightness, its staying power, or its rheology, to be modified by adding one or more additional compounds in quantities selected by the user;

to enable the substance to be heated, where appropriate, by being placed in a microwave oven, and consequently to make the temperature of the substance uniform in the event of a temperature gradient arising inside the receptacle;

to increase the extractable fraction, e.g. so as to reach an extractable fraction greater than or equal to 90%, or even 95%, or more; and to enable a mirror to be mounted thereon, where appropriate.

The invention seeks to satisfy all or some of the above requirements.

In one of its aspects, the invention provides a device for packaging and applying a substance, the device comprising:

a receptacle for containing the substance, the receptacle comprising:

a first part and a second part, the second part being turnable by the user relative to the first part; and an applicator.

The applicator can be loaded with substance by turning the first and second parts relative to each other.

The second part may define at least one surface in contact with the substance inside the receptacle, the applicator and said surface being arranged in such a manner that turning said surface causes pressure to be exerted on the substance, thereby causing the substance to move towards the applicator. This movement of the substance can take place in some embodiments around and/or through the applicator, in one direction only or in several directions, e.g. in two opposite directions in alternation. Said surface is preferably configured in such a manner that substantially all of the substance contained in the receptacle can be used. Advantageously, the substance can thus be caused to move towards the applicator until the receptacle has been emptied substantially completely.

In non-limiting embodiments of the invention, the device may include an anti-rotation system allowing the first part to turn relative to the second part in one direction only. Such an anti-rotation system may comprise, for example, at least one elastically-deformable tab carrying a pawl that moves in contact with a ratchet.

By way of example, the tab can be made with one of the first and second parts and the ratchet with the other one of the second and third parts.

The applicator may optionally be removable. When the applicator is removable, it can be secured to the receptacle when not in use, and can contribute to closing it.

The substance is suitable for being made uniform, where appropriate, inside the receptacle by the mixing caused by turning the above-specified surface.

The device may advantageously be used for packaging a substance of creamy, pasty, or gelled consistency, such as mascara, for example.

The invention enables the substance to be dispensed onto the applicator even when the device is of a shape that is wide rather than long. The invention thus makes it possible to change the appearance of the devices used for packaging and applying mascara, for example. For example the invention may enable the overall bulk of the device to be reduced, thus making it easier to transport.

The ratio of the height of the receptacle over the greatest transverse dimension of the receptacle may lie in the range 0.1 to 10, for example, being close to 1, for example.

The substance may be contained in an inside space of the receptacle and the ratio of the height of said inside space over the greatest transverse dimension of the receptacle may lie in the range 0.1 to 10, for example.

If so desired, the invention makes it possible to make the device in such a manner as to enable a mirror to be secured thereto, which is not true of conventional devices for packaging and applying mascara.

By way of example, the first and second parts may co-operate by snap-fastening so as to enable them to turn relative to each other while preventing any relative displacement in an axial direction.

The first and second parts may be assembled together so as to present a junction that is leaktight. To this end, one of the first and second parts may include a sealing gasket or a sealing lip co-operating with the other one of said parts, for example.

The first part may define an inside space containing the substance. In a variant, the first and second parts may together define the inside space containing the substance. The first and second parts may in particular define the size of such a space.

The applicator may be situated in the center of the receptacle and the above-mentioned surface may be configured in such a manner that on turning it moves the substance towards the center of the receptacle. In particular, the surface may turn about the applicator when the applicator is arranged for being refilled with substance by being inserted into the receptacle.

The surface that moves the substance towards the center of the receptacle on being turned need not be plane, and may be oriented in such a manner as to encourage flow towards the center of the receptacle.

Where appropriate, the surface may also be inclined upwards or downwards in such a manner as to produce also a flow of substance towards the top or the bottom of the receptacle.

The second part may co-operate with the first part to define at least two chambers inside the receptacle, with turning of the second part relative to the first part causing the volume of one of the chambers to vary in one direction and the volume of the other chamber to vary in the opposite direction. In such an embodiment, the applicator may be disposed substantially on the path of the substance flowing from one of the chambers towards the other chamber.

The first and second parts may also define a chamber of variable volume, and turning the second part may cause the volume of said chamber to decrease, and cause the substance to be dispensed towards the applicator.

The substance may be dispensed, for example, in a direction parallel to the axis of rotation of the second part, and in particular towards the applicator, in particular when the applicator is not housed inside the receptacle.

In a variant, the substance may be dispensed in some other direction, for example a direction that is not parallel to the axis of rotation, and in particular in a direction that is perpendicular thereto.

The first part may include a bottom wall having a first portion in relief and a second portion in relief co-operating with the first portion in relief so as to guide pivoting of the second part relative to the first part. The first portion in relief may be constituted, for example, by an indentation and the second portion in relief by a stud engaged in said indentation, or vice versa.

The second part may include a blade. The term "blade" should be understood broadly. The blade may be made integrally with the second part. In a variant, the blade may comprise at least one piece that is fitted to the second part. This piece may be made of a material that is different from the material used for making the remainder of the second part, for example, a material that is more rigid or more flexible, depending on the intended result. When the blade is a separate fitting, it may be secured to the remainder of the second part by snap-fastening, for example.

The blade may be pierced by at least one opening, or by a plurality of openings, e.g. in order to reduce the force needed to cause the second part to turn relative to the first part, and where appropriate in order to mix the substance.

The second part may include an outer skirt that can be turned by the user.

The second part may also include a neck which may be threaded on the outside so as to enable an internally-threaded closure cap to be secured thereto. Other means for fastening a closure cap on the neck may be used.

The above-mentioned surface may extend to a wall of the first part radially defining the outside of the inside space containing the substance. By way of example, this can enable a radially-outer edge of the second part to scrape substance off said wall and improve emptying. The surface in question may extend at least in part parallel to the axis of rotation of the second part. Said surface may also extend at least in part in a radial plane containing the axis of rotation of the second part. Said surface may extend about at least two radii, and said surface may be continuous. Said surface may optionally intersect the axis of rotation. In particular, said surface may be skew to a certain extent, specifically it may present a shape that is adapted to improving the flow of substance over the entire height of the applicator. Said surface may be configured specifically to cause the substance to rise which would otherwise tend to accumulate at the bottom of the receptacle. Said surface may thus be arranged to lift the substance as it turns and it may present a portion that slopes downwards and in its travel direction.

Said surface may also present a bottom edge that matches substantially the shape of a bottom wall of the receptacle so as to scrape off substance that has become deposited on said bottom wall. Said surface may have a radially-inner edge that is curved downwards and inwards, for example, so as to match substantially the shape of an applicator housed in said inside space. Said surface may present a radially-outer edge substantially matching the shape of a side wall of the receptacle. Said surface may present a radially-inner edge that substantially matches the profile of the applicator.

The device may include a handle member having a longitudinal axis substantially perpendicular to the axis of rotation of the second part. Where appropriate said handle member may coincide with that of the applicator.

The first part may define a backing surface and the above-mentioned surface may come to face the backing surface, at least in part, at the end of a turning stroke of the second part.

The backing surface may extend substantially radially towards the center of the receptacle. By way of example, said backing surface may be defined by a partition projecting into the inside space of the receptacle containing the substance.

The first part may include an outer covering.

The second part may be made as a single piece of plastics material. In a variant, the second part may comprise a plurality of component elements that are made separately and subsequently assembled together. By way of example, the second part may then comprise an outer portion and an inner portion secured to the outer portion, the inner portion being capable of turning relative to the first part without moving axially. For example, the inner portion may have an annular sealing lip that presses against the first part.

The first and second parts may be made out of different materials, thus enabling friction between the two parts to be reduced and making it easier to turn one part relative to the other.

The device may include a dip tube.

The blade and/or the backing surface may extend at least in part along an axis that is inclined relative to the axis of rotation so as to urge the substance towards the top or the bottom of the receptacle. Under such circumstances, the substance may then be conveyed via a chimney towards the top, or else it may be held level with an inlet orifice of a dip tube in communication with a dispenser means.

The device may include a wiper member for wiping the applicator.

The wiper member may be molded together with the first and/or the second part, or it may be fitted to one of them, in particular it may be fitted to the second part.

When a second part comprises an outer portion and an inner portion, one of the outer portion and the inner portion may carry the wiper member of the applicator. The wiper member may be made integrally with the inner portion, for example.

The wiper member may be made out of a material that is different from that of the first and second parts and it may be fitted to one of the first and second parts, or one of them may be overmolded thereon.

The wiper member may be made of an injection-molded plastics material or out of a foam, and where appropriate the wiper member may be flocked. One of the first and second parts may include a perforated central chimney. The applicator may be received in the chimney.

By way of example, the applicator may be secured to a closure cap.

By way of example, the applicator may extend inside the receptacle when the closure cap is in place thereon.

The applicator may include a stem extending substantially parallel to the axis of rotation of the second part. In a variant, the applicator may include a stem extending substantially perpendicularly to the axis of rotation of the second part, or having some other orientation. The stem may also be curved.

Where appropriate, the stem may present a narrow portion which comes into position in register with the wiper member when in the storage position, thereby avoiding stressing the wiper member.

The applicator maybe housed inside the receptacle in a space having the above-mentioned surface extending therearound.

The applicator may comprise a brush, in particular a brush configured to apply substance to keratinous fibers, for example the eyelashes and/or the eyebrows.

The applicator need not be a brush, and for example it may comprise an endpiece made of elastomer or some other material, a felt, or a foam, and it may optionally be flocked. The applicator may have one or more cavities for filling with substance. The applicator may also comprise a ball, like a roll-on applicator. The applicator may include a grid that is flocked, at least in part.

When the applicator comprises a stem and an applicator element, the applicator element may have in cross-section a maximum dimension that is, for example, less than, equal to, or greater than the diameter of the stem, depending on the nature of the applicator element.

In a variant embodiment, the applicator does not extend into an inside space of the receptacle filled with substance. The device may include, for example, a permeable wall between the applicator and an inside space of the receptacle containing the substance.

The applicator may be secured to the second part at least when in use. The second part may include an internal duct arranged to feed substance to the applicator.

The device may include a closure cap. In which case, the device may include a system for locking rotation of the closure cap relative to one of the first and second parts.

For example, the substance may be selected from: mascara, eye shadow, lipstick, eyeliner, a self-tanning substance, a care product, in particular a lip care product, an anti-acne product, a spot concealer, a concealer of rings under the eyes, an after-sun product, a hair-care product, a dermatological product, a foundation, a deodorant, a care product for application around the eyes, this list not being limiting.

The substance may be solid or semi-solid at ambient temperature (20° C.).

By way of example, the substance may contain at least two phases that are immiscible, and it may be made uniform by turning the first part relative to the second part.

The second part may include at least two blades.

In some embodiments, the applicator may be off-center relative to the axis of rotation of the second part relative to the first. For example, the applicator may be swept through the substance when one of the parts turns relative to the other.

Independently or in combination with the above, the invention also provides a device for packaging and applying a substance, the device comprising:

a receptacle for containing the substance, the receptacle comprising:

a first part and a second part, the second part being turnable by the user relative to the first part; and an applicator suitable for placing inside the receptacle in order to be loaded with substance;

the first part co-operating with the second part to define two chambers inside the receptacle, turning the second part relative to the first part causing the volume of one of the chambers to vary in one direction and the volume of the other chamber to vary in the opposite direction, and vice versa, the applicator being placed on the path of the substance flowing from one of the chambers towards the other chamber.

The extent to which the applicator is loaded can be controlled, where necessary, by acting on the amplitude with which one of the parts is turned relative to the other part.

In another of its aspects, the invention also provides a device for packaging and applying a substance for application to the skin, to the mucous membranes, to the nails, or to hair, the device comprising:

a receptacle for packaging the substance, said receptacle comprising a first part and a second part capable of turning relative to the second part about an axis of rotation; and an applicator suitable for being releasably secured to one of said parts, in a manner that is off-center relative to the axis of rotation, the applicator including an applicator element placed inside the receptacle in such a manner as to move in contact with the substance present in the receptacle when the two parts turn relative to each other.

The invention also provides a method of loading the applicator of a device as defined above with substance, in which method the second part is caused to turn relative to the first part through an angle that is predefined as a function of the quantity of substance that it is desired to deposit on the applicator.

In another of its aspects, the invention also provides a kit comprising:

a receptacle for containing the substance, the receptacle comprising:

a first part and a second part, the second part being turnable by the user relative to the first part; and an applicator.

the second part defining at least one surface in contact with the substance inside the receptacle, the applicator and said surface being arranged in such a manner that turning said surface exerts pressure on the substance, causing the substance to move towards the applicator, at least one additional compound for adding to the substance contained in the device.

By way of example, the additional compound is a solvent, a coloring agent, a gloss agent, a lubricating agent, e.g. an oil.

In another of its aspects, the invention also provides a method of making up in which the user inserts a desired quantity of at least one additional compound into the device as a function of the desired results, then makes the substance uniform by turning the first part relative to the second part.

BRIEF DESCRIPTION OF THE DRAWINGS

The invention can be better understood on reading the following detailed description of non-limiting examples thereof, and on examining the accompanying drawings, in which.

DETAILED DESCRIPTION OF EMBODIMENTS

Figure 1:
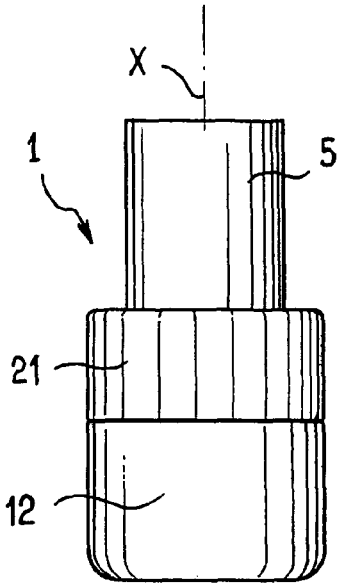
FIG. 1 is a diagrammatic elevation view of an example of a device made in accordance with the invention.

FIGS. 1 to 4 show a packaging and applicator device 1 made in accordance with the invention.

The device 1 comprises a receptacle having a first part 10 and a second part 20 capable of turning relative to the first about an axis of rotation X coinciding with the longitudinal axis of the device 1 in the example described.

The device 1 further comprises an applicator 2, which itself includes an applicator element 3 constituted by a brush in the example shown.

The applicator element 3 is connected by a stem 4 to a handle member 5 which also constitutes a closure cap for the receptacle.

In the example shown, the stem 4 extends along the axis of rotation X, however it could be located elsewhere without thereby going beyond the ambit of the present invention.

The stem 4 may be made, for example, at least in part out of a plastics material, and it may comprise at least one material such as: polyimide (PA); polyethylene (PE); polypropylene (PP); polystyrene (PS); acrylonitrile-butadiene-sytrene copolymer (ABS); sytrene acrylonitrile copolymer (SAN); polyacetyl (POM) or polyethylene terephthalate (PET); this list not being limiting.

In the example described, the first part 10 comprises a pot 11 which may be engaged inside an outer covering 12, for example. The covering may extend over a fraction only of the height of the pot 11.

By way of example, the covering 12 may be retained on the pot 11 by friction, adhesive, heat-sealing, or snap-fastening, the covering being made out of a metal, for example, while the pot 11 is made out of a thermoplastic material.

The covering 12 may, where appropriate, be made out of an elastomer material, e.g. a thermoplastic elastomer, and it may include projections on its surface making it easier for a user to hold.

In the example described the pot 11 has a top portion 13 in relief and an annular sealing lip 14.

Figure 4:
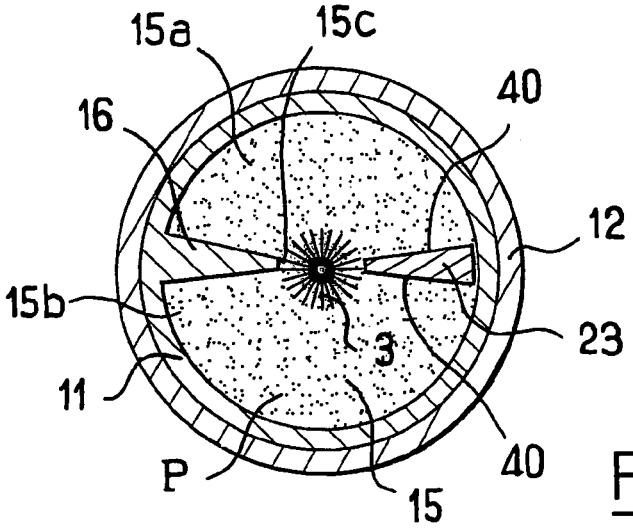
FIG. 4 is a fragmentary and diagrammatic cross-section on IV-IV of FIG. 3.

As can be seen in FIG. 4, the pot 11 defines an inside space 15 in which a substance P is contained. The inside space 15 may correspond in particular to the space occupied by the substance prior to first use. The level of substance is then at its maximum inside the receptacle, reaching a height hi, as measured from the bottom outside face of the receptacle.

The pot 11, which may be made out of at least one plastics material, e.g. PE, PP, PA, POM, PS, ABS, SAN, or PET, this list not being limiting, includes a partition 16 extending radially towards the center of the inside space 15 to the vicinity of the applicator element 3, and being substantially complementary in shape thereto.

The second part 20 has an outside skirt 21 arranged to snap-fasten on the portion 13 in relief and made integrally in the example described with a threaded neck 22 suitable for securing the closure cap 5.

The portion 13 in relief is made, for example, in the form of a continuous or discontinuous annular bead so as to hold the first part 10 axially relative to the second part, while allowing them to turn relative to each other.

Figure 7:
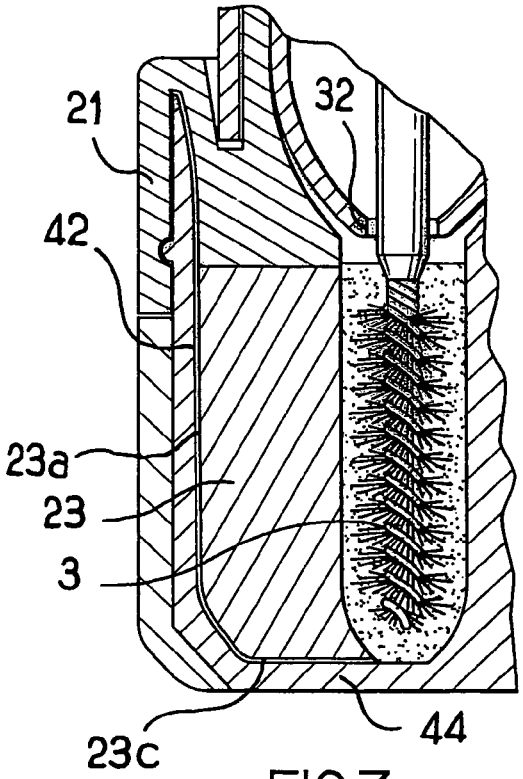
FIG. 7 is a fragmentary axial section of a variant embodiment of the FIG. 1 device.

The second part 20 includes a blade 23 made integrally with the skirt 21 and the neck 22, in the example described. In the variant embodiment shown in FIG. 7, the blade 23 is fitted to the remainder of the second part 20, thus making it easier to make the blade 23 out of a different material, if so desired.

The blade 23 preferably presents a shape that matches the shapes both of the applicator element 3 and of the pot 11.

Figure 3:
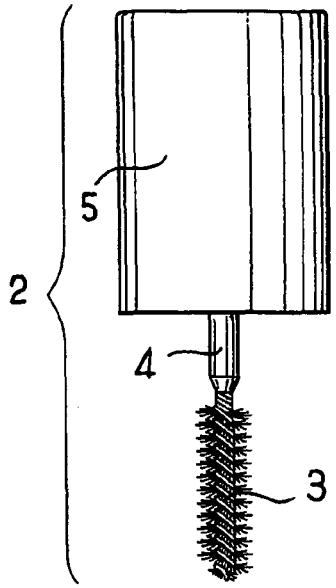
FIG. 3 is a diagrammatic and fragmentary axial section of the FIG. 1 device.
Figure 3:
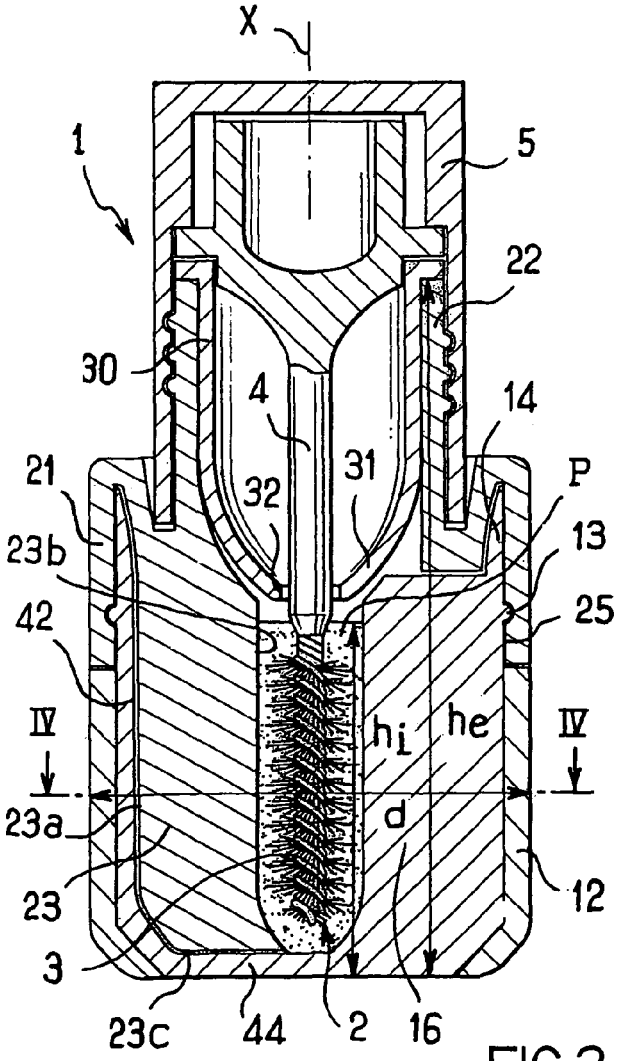
Figure 2:
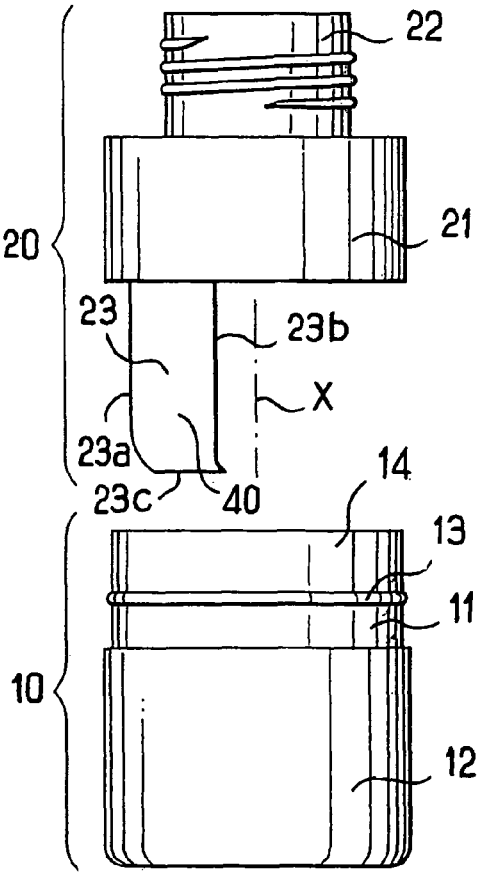
FIG. 2 is an exploded view of the FIG. 1 device.

In the example of FIG. 3, the blade 23 presents a radially outer edge 23*a* of profile enabling it to come close to the radially inside surface 42 of the pot 11 so as to scrape off the substance.

The radially inner edge 23*b* of the blade 23 has a downwardly and inwardly curved bottom portion that substantially matches the shape of the applicator element 3.

The bottom edge 23*c* of the blade 23 substantially matches the shape of the bottom wall 44 of the receptacle so as to scrape the substance that is present thereon.

The second part 20 may be made out of at least one plastics material, e.g. out of PE, PP, PA, POM, PS, ABS, SAN, or PET, this list not being limiting.

It may be advantageous to use different materials for making the first and second parts, in order to reduce friction between them.

When the second part 20 is in place on the first part 10, as shown in FIG. 3, the annular sealing lip 14 presses against the radially inside surface 25 of the skirt 21 so as to seal the assembly. Other sealing means could be used.

As can be seen in FIG. 3, the device 1 may include a wiper member 30 suitable for being inserted in the neck 22 to wipe the applicator element 3 as it leaves the receptacle.

The wiper member 30 may be of any type, and for example it may have a flexible lip 31 defining a circular orifice 32 at its bottom end, the diameter of the orifice being substantially equal to the diameter of the stem 4. In a variant, the orifice 32 may have some other diameter and/or may be of a shape that is not circular.

The wiper member 30 may be made of a plastics material, for example of PE, PP, POM, PET, nitrile, silicone, ethylene polypropylene diene (EPDM), sytrene-isoprene-sytrene (SIS), or sytrene ethylene polypropylene butadiene-sytrene (SEBS), a thermoplastic polyester elastomer such as that known under the trademark Hytrel®, for example, a thermoplastic elastomer such as that known under the trade name Santoprene®, for example, this list not being limiting.

The wiper member 30 need not be fitted in the neck, but could be molded therewith or the neck could be overmolded thereon.

Figure 5:
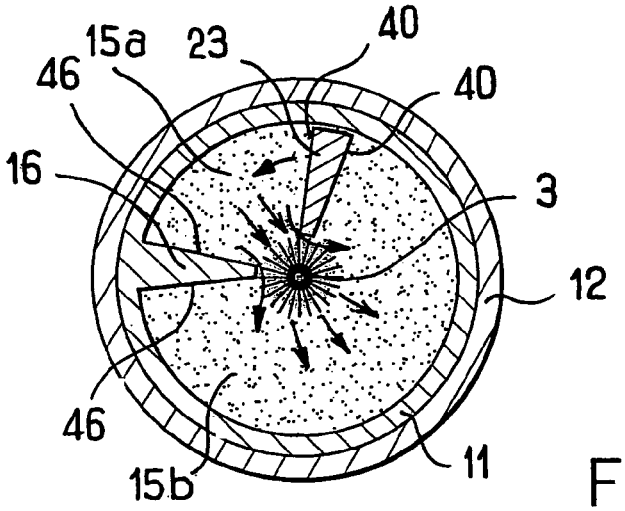
FIGS. 5 and 6 are views analogous to FIG. 4 after the second part has been turned relative to the first.
Figure 6:
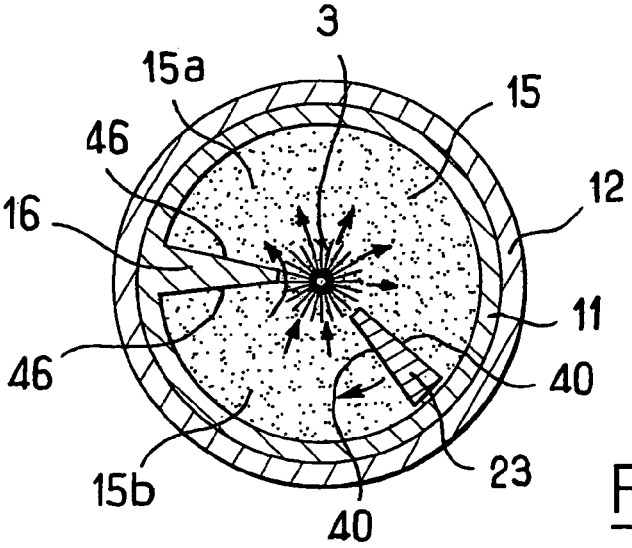

As can be seen in particular in FIGS. 4 to 6, the blade 23 and the partition 16 together define two chambers 15*a* and 15*b* inside the space 15, which chambers communicate with each other via a central region 15*c* in which the applicator element 3 is situated when the applicator 3 is in place on the receptacle.

Each main face of the blade 23 defines a rotary surface 40, one of which exerts thrust on the substance, depending on the direction in which the second part 20 is being turned.

The partition 16 defines backing surfaces 46. At the end of turning the second part 20 relative to the first part 10, one of the rotary surfaces 40 comes substantially to overlie one of the backing surfaces 46.

When the user turns the second part 20 relative to the first part 10 in either direction, the movement of the blade 23 inside the space 15 causes the volume of one of the chambers 15*a* or 15*b* to decrease while causing the volume of the other chamber to increase, thereby causing the substance to flow from one chamber towards the other through the central region 15*c*, and thus enables the applicator element 3 to be filled with substance.

In the example of FIG. 5, it is the volume of the chamber 15*a* that is decreasing while the volume of the chamber 15*b* is increasing, so the substance flows from the chamber 15*a* into the chamber 15*b*, whereas FIG. 6 shows the contrary situation.

When the second part 20 is turned relative to the first part 10, e.g. with the user holding the covering 12 in one hand and turning the outer skirt 21 with the other hand, the movement of the blade 23 in the inside space 15 causes the substance P to be stirred to some extent, which can contribute to making it uniform.

In the example shown, the ratio he/d of the height the of the receptacle formed by the first and second parts when assembled together divided by the greatest transverse dimension d of the receptacle can lie in the range 0.1 to 10, for example in the range 0.1 to 2, and in particular it is possible for d>he/2, which gives the device a relatively stocky outline, very different from the highly elongate appearance of conventional prior art devices for packaging and applying mascara.

The ratio hi/d of the height hi of the inside space 15 of the receptacle over the greatest transverse dimension d of the receptacle may lie in the range 0.1 to 10, for example, and in particular it is possible for d>hi.

Figure 8:
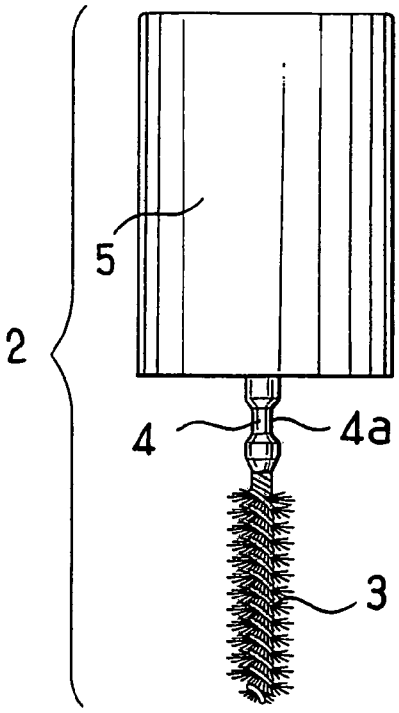
FIGS. 8 and 9 are diagrammatic elevation views of various embodiments of the applicator.
Figure 9:
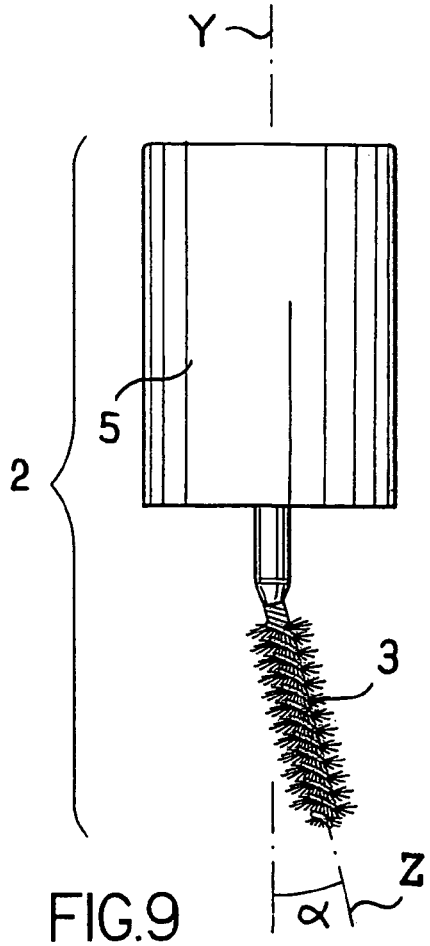

The stem 4 of the applicator can be made with a narrow portion 4*a* as shown in FIG. 8. The narrow portion 4*a* can take up a position in register with the orifice 32 in the wiper member, the diameter of the orifice 32 then preferably being substantially equal to the diameter of the stem 4 other than in its narrow portion 4*a*. The presence of the narrow portion 4*a* reduces the stresses exerted by the stem 4 on the wiper member when the applicator is in position on the receptacle. Where appropriate, and as shown in FIG. 9, the applicator element 3 may extend along a longitudinal axis Z that makes a non-zero angle $\alpha$ with the longitudinal axis Y of the applicator.

In the embodiment of FIG. 1, the inside space containing the substance is defined laterally solely by the pot 11.

Figure 10:
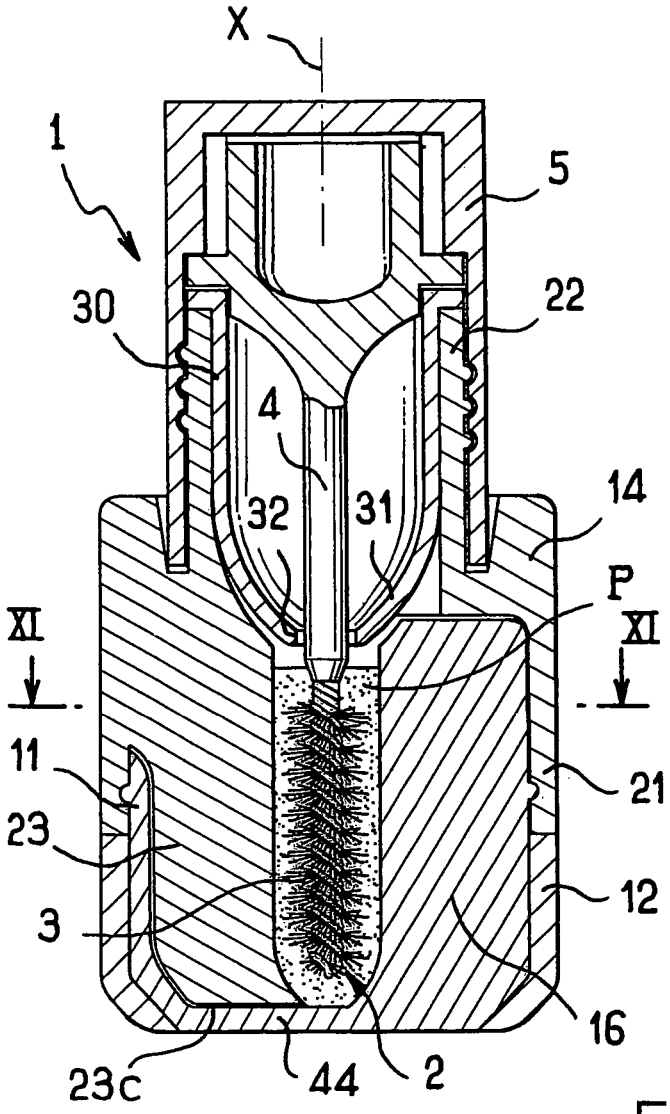
FIG. 10 is an axial section view of another variant embodiment of the FIG. 1 device.
Figure 11:
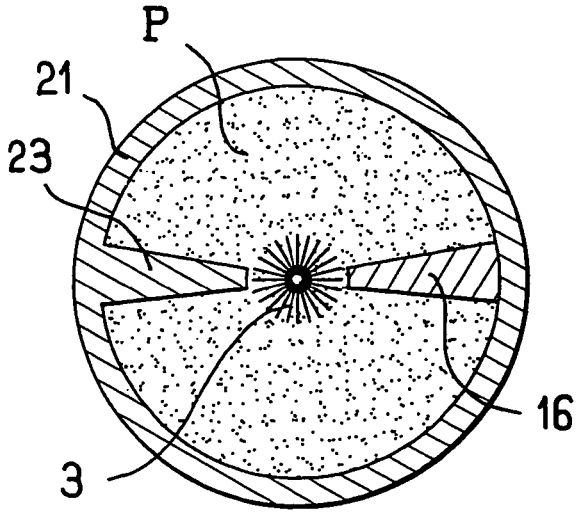
FIG. 11 is a cross-section on XI-XI of FIG. 10.

In the variant shown in FIGS. 10 and 11, the inside space containing the substance is defined laterally towards the bottom by the pot 11 and towards the top by the outer skirt 21 of the second part 20.

Figure 12:
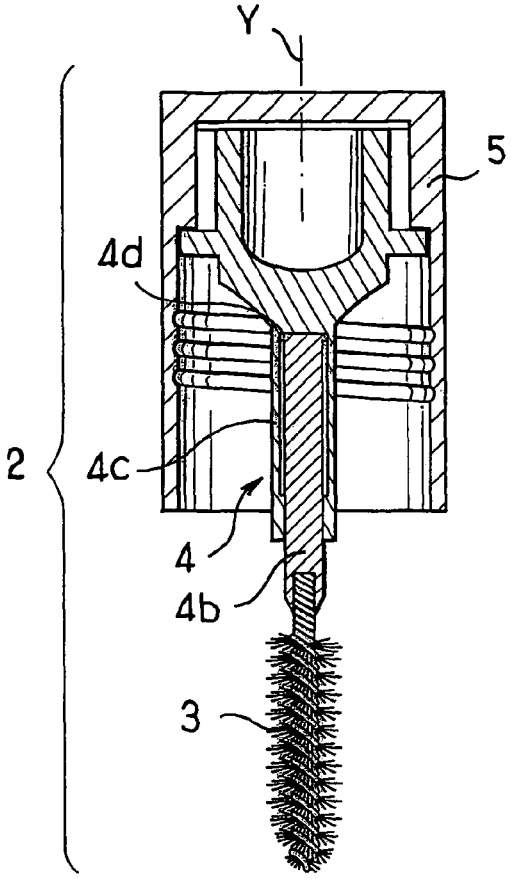
FIGS. 12 and 13 are an axial section view of an example of an applicator having a telescopic stem, the stem being shown respectively in a retracted position and in an extended position.
Figure 13:
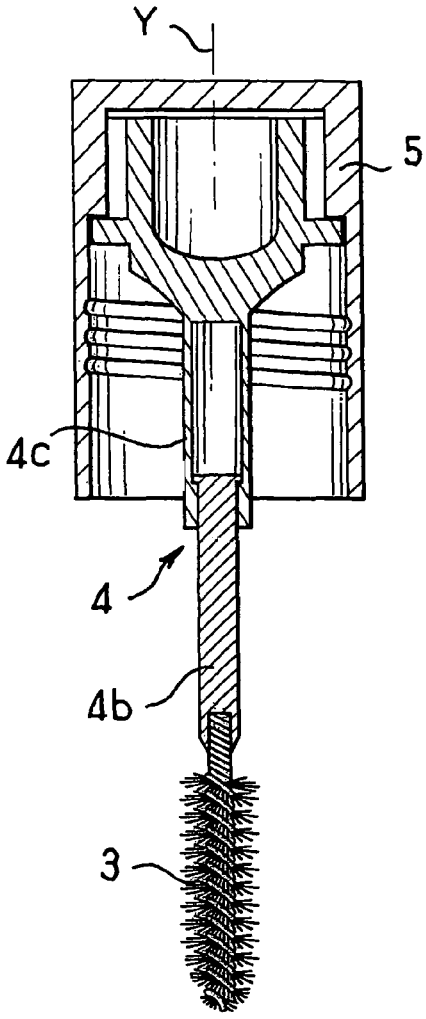

The stem 4 of the applicator may be telescopic as shown in FIGS. 12 and 13.

The stem 4 may comprise a first portion, e.g. a bottom portion 4*b* engaged inside a second portion, e.g. a top portion 4*c*, and capable of sliding inside it parallel to the longitudinal axis Y of the applicator. The bottom portion 4*b* may be made with one end in relief enabling its travel stroke in the other portion 4*b* to be limited.

When the applicator 2 is in place in the receptacle, the stem 4 is in its retracted position as shown in FIG. 12.

When the user seeks to extract the applicator element 3 from the receptacle, the applicator element 3 can bear against the wiper member 30, thus enabling the stem 4 to be deployed and bringing it into the configuration shown in FIG. 13.

Once the stem 4 is deployed, the user can cause the applicator element 3 to pass through the wiper member 30.

On returning the applicator element 3 into the receptacle, the stem 4 may begin by retracting, after which the applicator element 3 passes through the wiper member.

Figure 14:
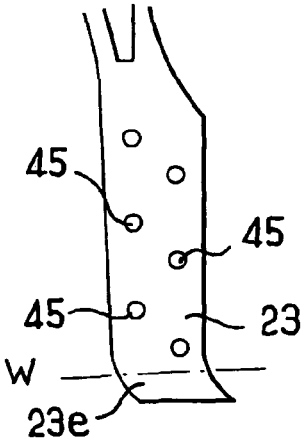
FIGS. 14 to 16 are elevation views showing examples of perforated blades in isolation.
Figure 15:
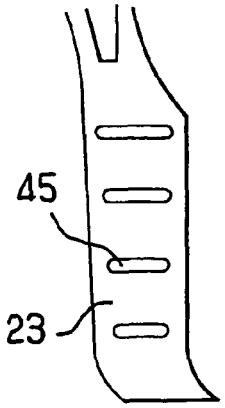
Figure 16:
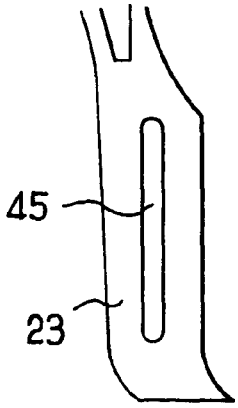

The use of a telescopic stem may naturally be associated with receptacles other than that shown in FIG. 1.

Where appropriate, and as shown in FIGS. 14 to 16, openings 45 may be formed in the blade 23 so as to allow the substance to pass through the blade while it is moving.

The blade 23 may have multiple openings 45, e.g. circular openings as shown in FIG. 14, or in the form of horizontal slots as shown in FIG. 15, or indeed a single opening 45, which may be in the form of a single vertical slot, as shown in FIG. 16, for example.

The through section made available to the substance by the opening(s) 45 is preferably small enough to ensure that the required quantity of substance nevertheless flows through the central region 15*c* when the blade 23 is moved.

Where appropriate, the blade 23 may be skew, e.g. presenting a bottom portion that is curved downwards and forwards relative to the direction the blade moves through the substance.

The blade 23 may include a portion 23*e* that is curved about an axis W perpendicular to the turning axis X, as shown in FIG. 14, so as to lift the substance while the blade is moving, and thus oppose accumulation of substance at the bottom of the receptacle under the effect of gravity.

Instead of curving the blade, it is also possible to make it thicker in its bottom portion so that the surface 40 that presses again the substance tends to lift it.

A skew blade could naturally be made without openings 45.

Figure 17:
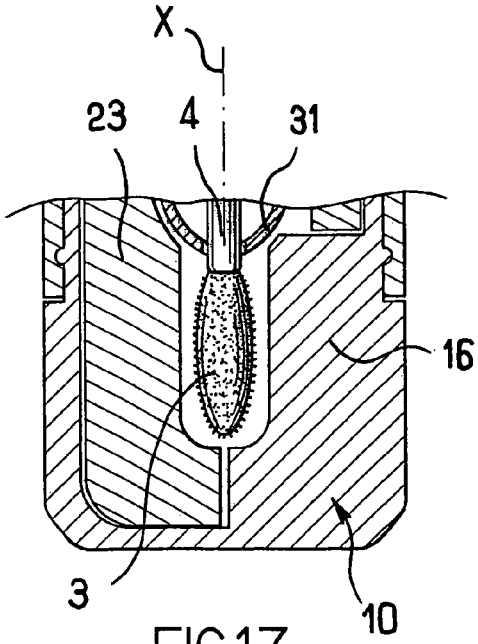
FIG. 17 is a fragmentary and diagrammatic axial section view of a variant embodiment.

The present invention is not limited to a particular applicator element 3, and by way of example FIG. 17 shows a variant embodiment in which the applicator element 3 comprises a flocked endpiece.

FIG. 17 also shows the possibility of making the first part 10 as a one-piece molding of plastics material, without using an outer covering 12.

In FIG. 17, it can be seen that the blade 23 can be made with a shape that is different, in particular its bottom portion may be L-shaped, the blade 23 extending under the applicator element 3 substantially as far as the axis X, for example.

The bottom portion of the partition 16 may likewise present an L-shape extending towards the inside substantially as far as the axis X.

The first and second parts may be organized in multiple other ways without that going beyond the ambit of the present invention.

Figure 18:
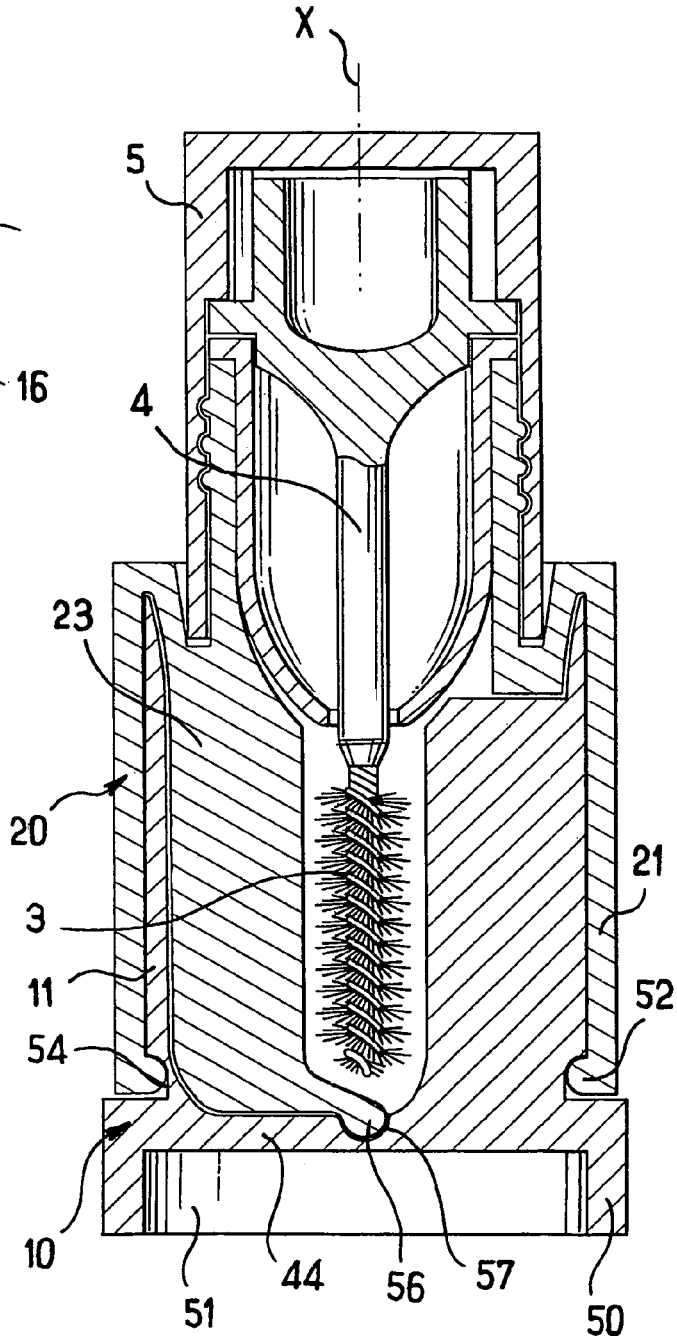
FIG. 18 is a diagrammatic axial section view of another variant embodiment.

By way of example, FIG. 18 shows a variant embodiment in which the bottom wall 44 is extended downwards at its periphery by a rib 50 defining a housing 51, e.g. suitable for housing a mirror or a product sample (not shown).

In this example, the outer skirt 21 of the second part is provided with at least one portion in relief, e.g. an annular bead 52, configured to engage in a corresponding groove 54 formed in the base of the pot 11.

FIG. 18 also shows that the blade 23 can be made with a first portion in relief, e.g. a stud 56 that co-operates with a second portion in relief, e.g. an indentation 57 made in the first part 10. The indentation 57 may be circularly symmetrical about the axis X so as to provide the bottom portion of the blade 23 with a certain amount of guidance while the second part 20 is turning.

Figure 19:
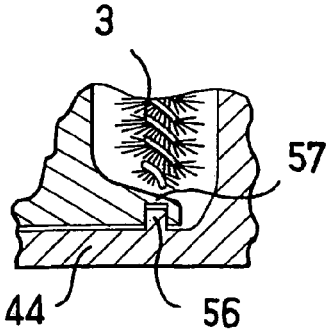
FIG. 19 is a fragmentary axial section view of a variant of the FIG. 18 device.

In the variant shown in FIG. 19, the stud 56 is made integrally with the bottom wall 44 and the indentation 57 is made integrally in the second part.

Where appropriate, at least one of the first and second parts can be made with a chimney in which the applicator element 3 is positioned when the applicator 2 is in place on the receptacle.

Figure 20:
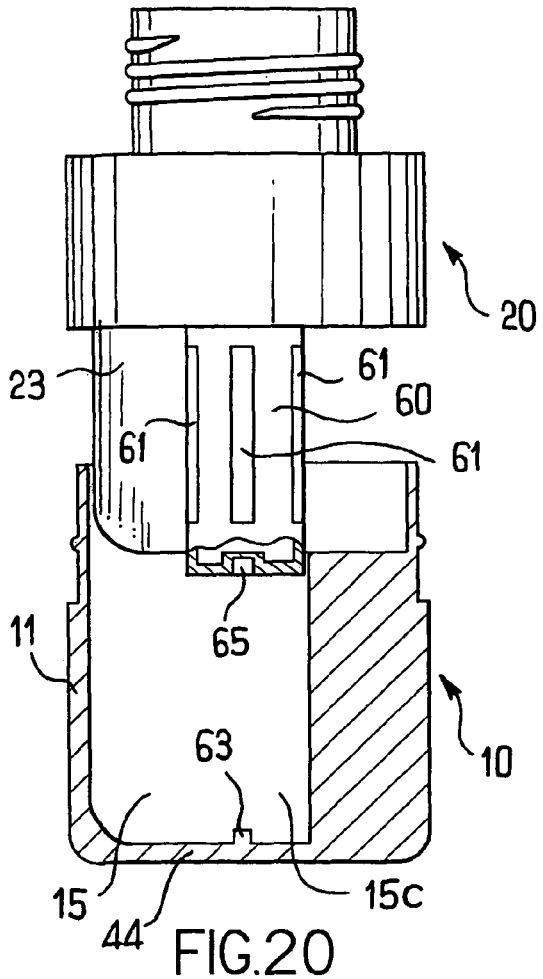
FIGS. 20 and 21 are diagrammatic exploded views partially in axial section of the first and second parts prior to assembly, in other variant embodiment.

In FIG. 20, the second part 20 is made with a chimney 60 that engages in the central region 15*c* of the inside space 15 of the pot 11, this chimney 60 being pierced by a plurality of openings 61 enabling the substance flowing from one of the chambers 15*a* or 15*b* towards the opposite chamber to pass therethrough and fill the applicator element 3 present therein.

The bottom wall 44 of the pot 11 may be made, where appropriate, with a first portion 63 in relief such as a stud arranged to co-operate with a second portion 65 in relief such as an indentation formed in the bottom wall of the chimney 60.

Figure 21:
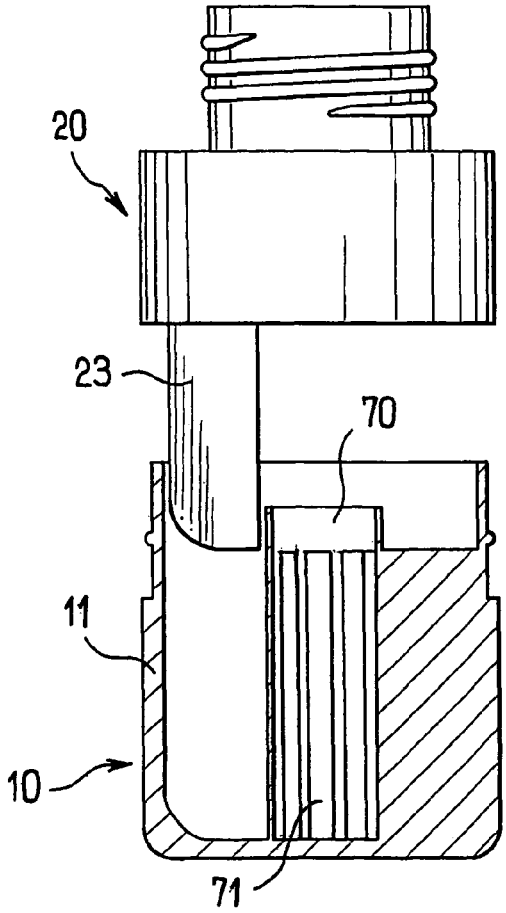

In the example of FIG. 21, it is the first part 10 that is made with the chimney 70 that includes, like the chimney 60 described above, openings 71, e.g. present in the form of slots that are elongate parallel to the axis X.

The applicator element 3 can be received in the chimney 70 while the applicator 2 is in place on the receptacle.

The second part 20 can be made as a single piece, by molding a plastics material, or in a variant by assembling together at least two pieces that are made separately and then assembled together.

Figure 22:
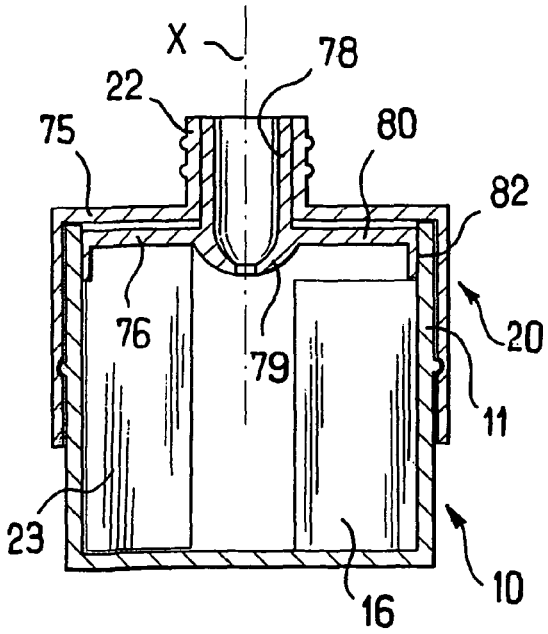
FIGS. 22 to 24 are other diagrammatic and fragmentary axial sections of additional variants.

In the example of FIG. 22, the second part 20 has an outer portion 75 co-operating with the first part 10 to hold the second part 20 axially while allowing it to turn about the axis X, and an inner portion 76 that turns together with the outer portion 75.

The outer portion 75 may be assembled to the inner portion 76 in various ways. The outer portion 75 may, for example, include the neck 22, and the inner portion 76 may include an insert 78 that is engaged in the neck 22, the insert 78 being made, for example, integrally with a wiper member 79. The inner portion 76 may also include, for example, a plate 80 supporting the blade 23 and provided at its periphery with an annular sealing lip 82 that bears against the radially inside surface of the pot 11.

Figure 23:
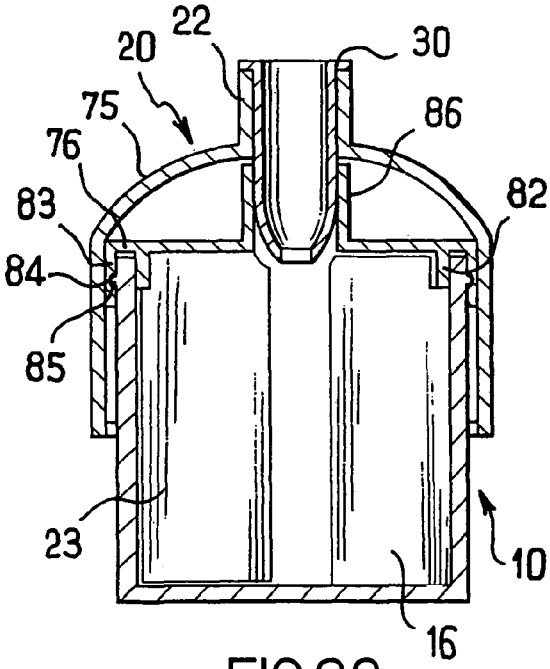

In the variant embodiment shown in FIG. 23, the second part 20 likewise has an outer portion 75 and an inner portion 76. In this example, it is the inner portion 76 that co-operates with the first part 10 in order to retain the second part 20 axially on the first part 10. The inner portion 76 comprises, for example, an outer skirt 83 with an inside groove 84 having an outside bead 85 of the pot 11 engaged therein to hold the second part 20 axially while allowing it to turn about the axis X. The inner portion 76 also includes an annular sealing lip 82 pressing against the radially inside surface of the pot 11. The outer portion 75 is assembled with the inner portion 76 by friction, for example. The wiper member 30 is fitted in the neck 22 which may be formed together with the outer portion 75, and it engages in leaktight manner in a chimney 86 formed together with the outer portion 75.

Figure 24:
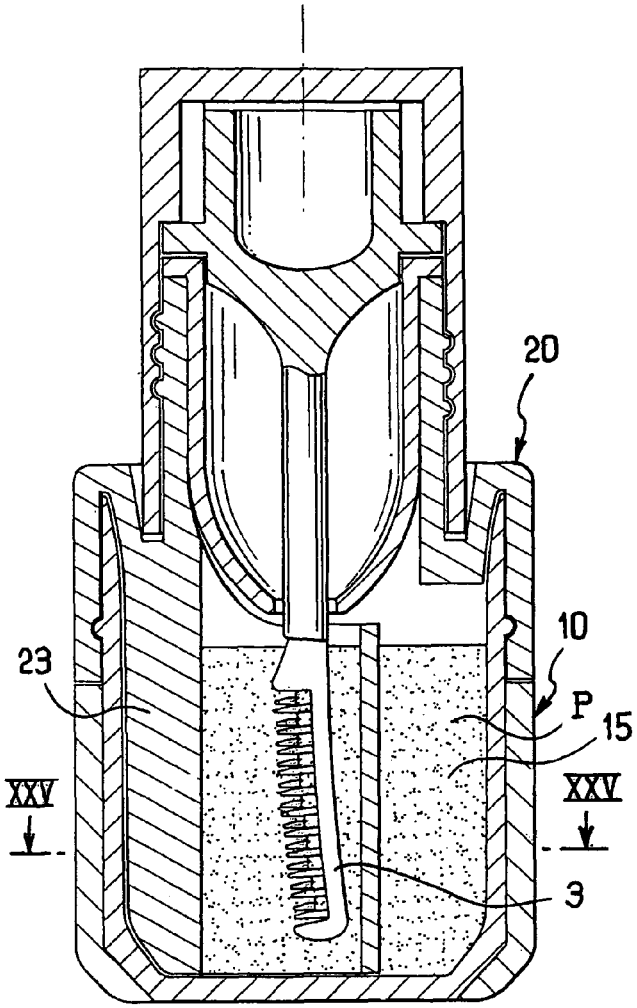
Figure 25:
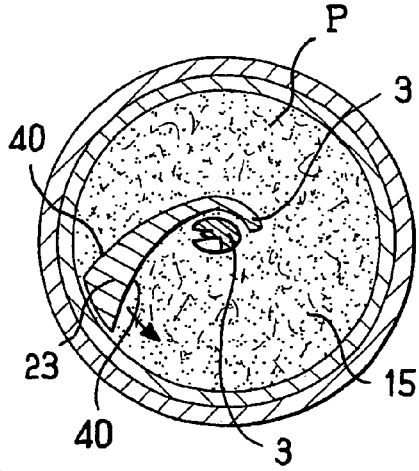
FIG. 25 is a cross-section on XXV-XXV of FIG. 24.

In the embodiments described above, the first part 10 has a partition 16 defining at least one backing surface 46. It would not go beyond the ambit of the present invention for the first part 10 to have no such partition, as shown in FIGS. 24 and 25. In this variant embodiment, the second part 20 has a blade 23 defining two rotary surfaces 40, at least one of which presents a shape that is curved in such a manner as to deflect the substance towards the center when said blade 23 is turned in the appropriate direction, e.g. the counterclockwise direction in the example shown in FIG. 25.

In the example of FIGS. 24 and 25, the inside space 15 has only one chamber. The substance P is moved inside said chamber when the second part 20 turns relative thereto.

In FIG. 24, there can also be seen the possibility of making the applicator in a form other than a brush, for example in the form of a comb made by injection-molding a plastics material.

In the examples described above, the applicator is extracted from the receptacle in a direction that is substantially parallel to the axis of rotation X.

Figure 26:
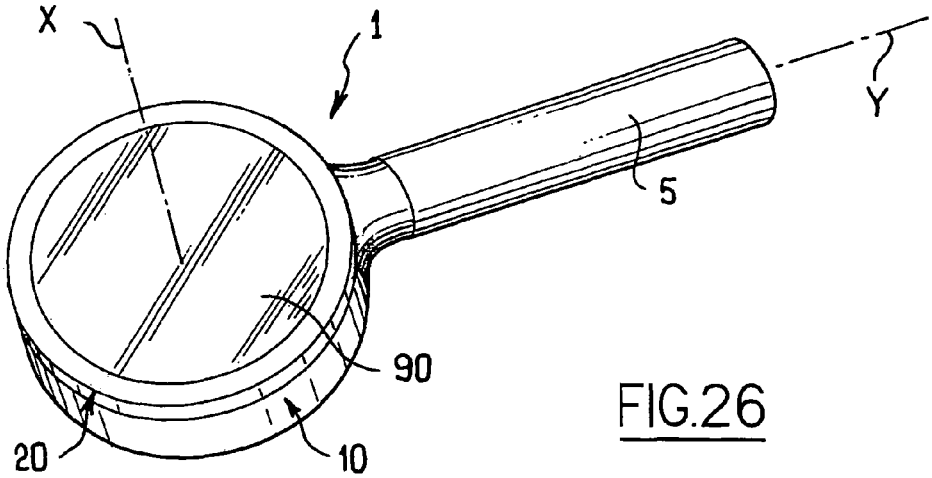
FIG. 26 is a diagram of a device constituting another embodiment of the invention.
Figure 27:
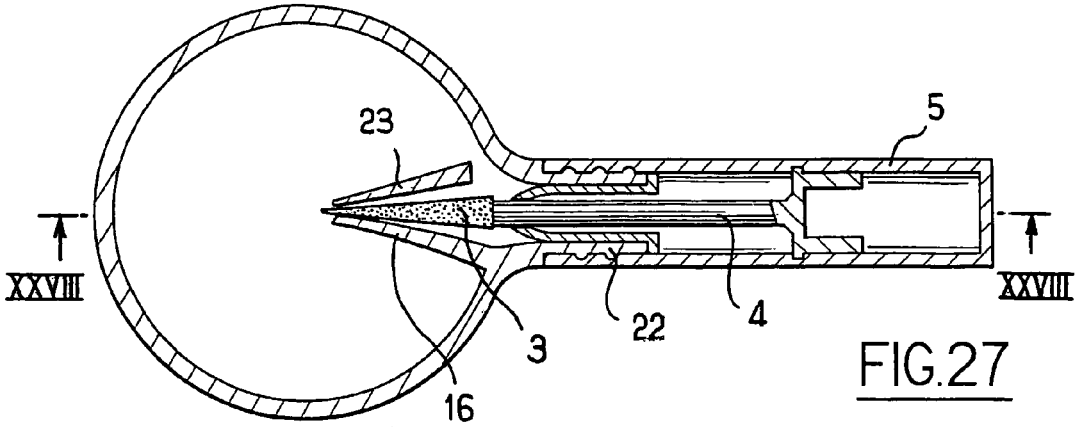
FIG. 27 is a diagrammatic and fragmentary longitudinal section view in a midplane of the FIG. 26 device.
Figure 28:
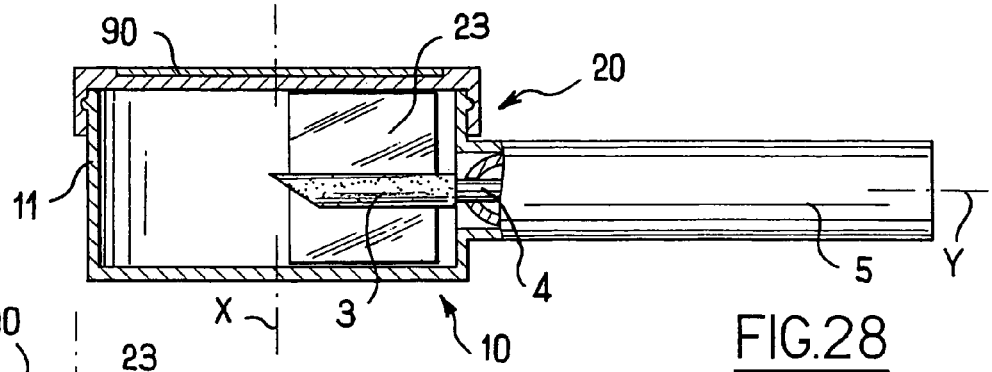
FIG. 28 is a fragmentary and diagrammatic section view on XXVIII-XXVIII of FIG. 27.

It would not go beyond the ambit of the present invention for the applicator to be extracted in a direction that is not parallel to the axis X, and in particular in a direction Y that is perpendicular to the axis X, as applies to the embodiment shown in FIGS. 26 to 28.

In this example, the device 1 comprises a first part 10 made with a neck 22 extending substantially perpendicularly to the axis X from the side of the first part 10. The pot 11 of the first part 10 is closed by the second part 20. By way of example, the partition 16 is made integrally with the pot 11 by molding material. The second part 20 may carry a mirror 90 on an outside face and a blade 23 which extends substantially parallel to the axis of rotation X.

The closure cap 5 may present an elongate shape so as to form a handle for the device 1 when the user seeks to make use of the mirror 90. This example shows that it is possible for the applicator element to be constituted by an element other than a brush, and specifically by an endpiece having a tapering tip, for example.

Figure 29:
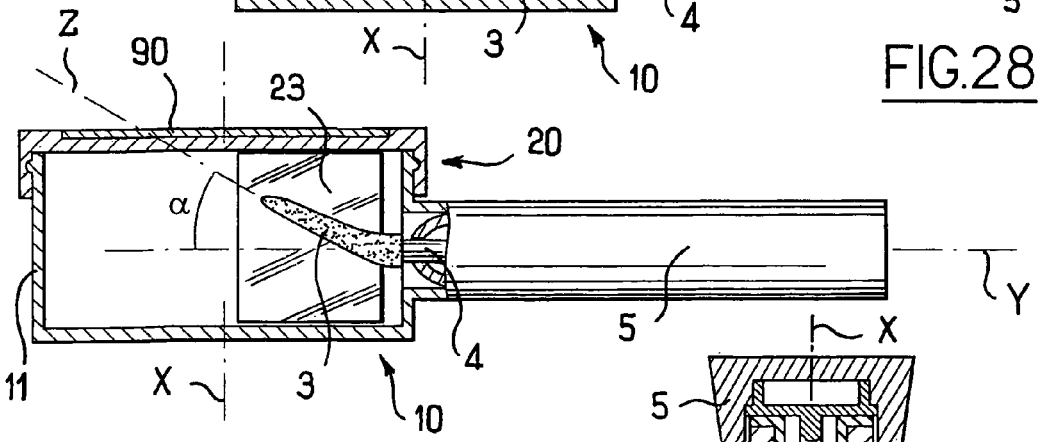
FIG. 29 is a view analogous to FIG. 28 showing a variant embodiment.

In FIG. 29, there can be seen the possibility of making the applicator element 3 of the applicator to have a longitudinal axis Z that makes a non-zero angle $\alpha$ with the longitudinal axis Y of the applicator.

Figure 30:
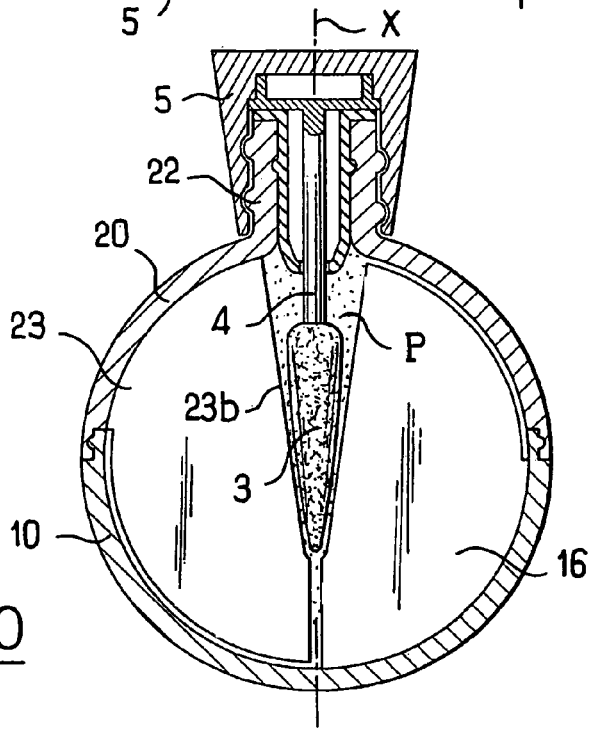
FIG. 30 is a diagrammatic axial section view of another variant embodiment.

FIG. 30 shows a variant embodiment in which each of the first and second parts presents a portion that is substantially hemispherical. In this figure, it can be seen that the radially inner edge 23*b* of the blade 23 can match substantially the profile of the applicator element. In this embodiment, the bottom of the receptacle is not plane.

In the embodiments described above with reference to the drawings, the applicator 2 comprises an applicator element 3 that is to be extracted from the device during utilization, and that is mounted at the end of the stem 4. In these examples, the applicator element 3 is housed inside the receptacle containing the substance whenever the closure cap 5 is in place on the receptacle.

It would not go beyond the ambit of the present invention for the applicator element 3 to be permanently secured on the device and/or not to be housed while not in use entirely in the space containing the substance.

Figure 31:
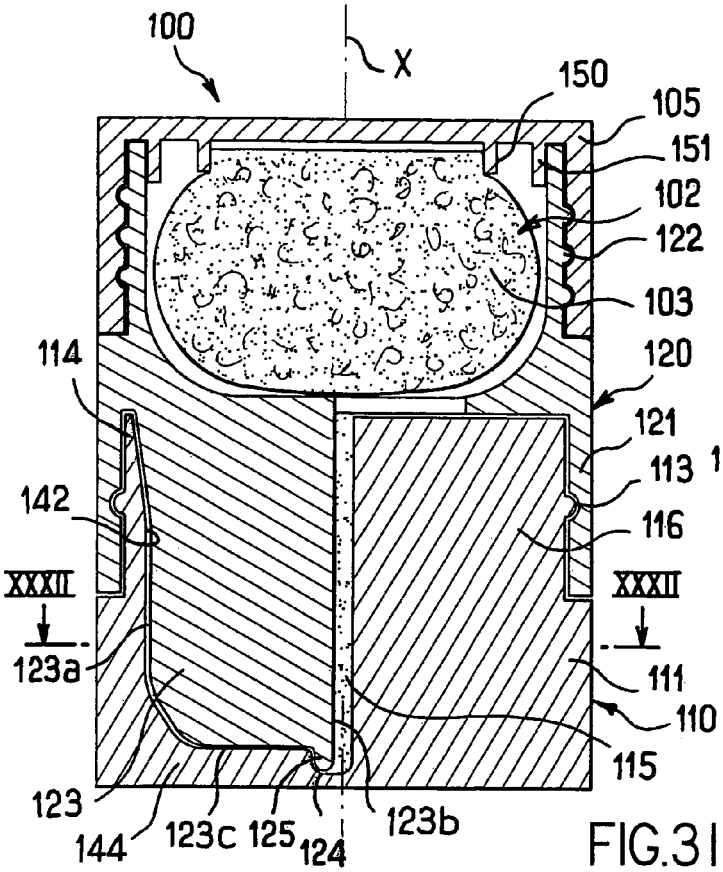
FIG. 31 is a diagrammatic axial section view of a variant embodiment in which the applicator is outside the space containing the substance.
Figure 32:
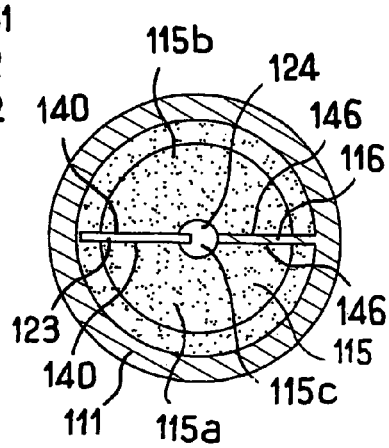
FIG. 32 is a cross-section on XXXII-XXXII of FIG. 31.

By way of example, FIGS. 31 and 32 show a device 100 having a first part 110 and a second part 120 that is capable of turning relative to the first part 110 about an axis of rotation R coinciding with the longitudinal axis of the device in the example described.

The device 100 further comprises an applicator 102, which in this example comprises an applicator element 103, e.g. comprising a foam, said applicator element 103 being carried by an inner skirt 150 of a closure cap 105 that also acts as a handle.

The cap 105 includes an annular sealing lip 151 pressing against the inside wall of a neck 122, which neck carries an outside thread, for example, and is made integrally with the second part 120.

In the example described, the first part 110 comprises a pot 111 defining an inside space 115, as can be seen in FIG. 32, with the substance being contained therein.

The pot 111 has a partition 116 extending radially towards the center of the inside space 115 to come close to the axis X, and near the top it has an annular sealing lip 114 provided on the outside with a portion 113 in relief serving to hold the second part 120. By way of example, the portion 113 in relief is an annular bead.

The second part 120 comprises an outer skirt 121 arranged to snap-fasten on the portion 113 in relief, and made integrally with the neck 122 in the example described.

A blade 123 is also made integrally with the outer skirt 121 and the neck 122 in the example described.

The radially inner edge 123*b* of the blade 123 is situated in a central region 115*c* of the inside space 115, preferably at a short distance from the radially inner edge of the partition 116.

In the example described, the bottom wall 144 of the pot 111 includes a first portion in relief, e.g. constituted by an indentation 124 that is arranged to co-operate with a second portion in relief, e.g. constituted by a stud 125 formed on the bottom edge 123*c* of the blade 123, so as to guide it when turning.

The radially outer edge 123*a* of the blade 123 extends nearly as far as the inside wall 142 of the pot 111, so as to scrape off the substance that becomes deposited on said wall 142.

The device of FIGS. 31 and 32 operates as follows.

The blade 123 defines two opposite rotary surfaces 140 and the partition 116 defines two associated backing surfaces 146.

The partition 116 co-operates with the blade 123 to define two chambers 115*a* and 115*b*. When the second part 120 is turned relative to the first part 110, the blade 123 moves, and its movement is accompanied by the volume of one of the chambers 115*a* or 115*b* decreasing and the substance leaving that volume to go towards the applicator element 103.

Figure 34:
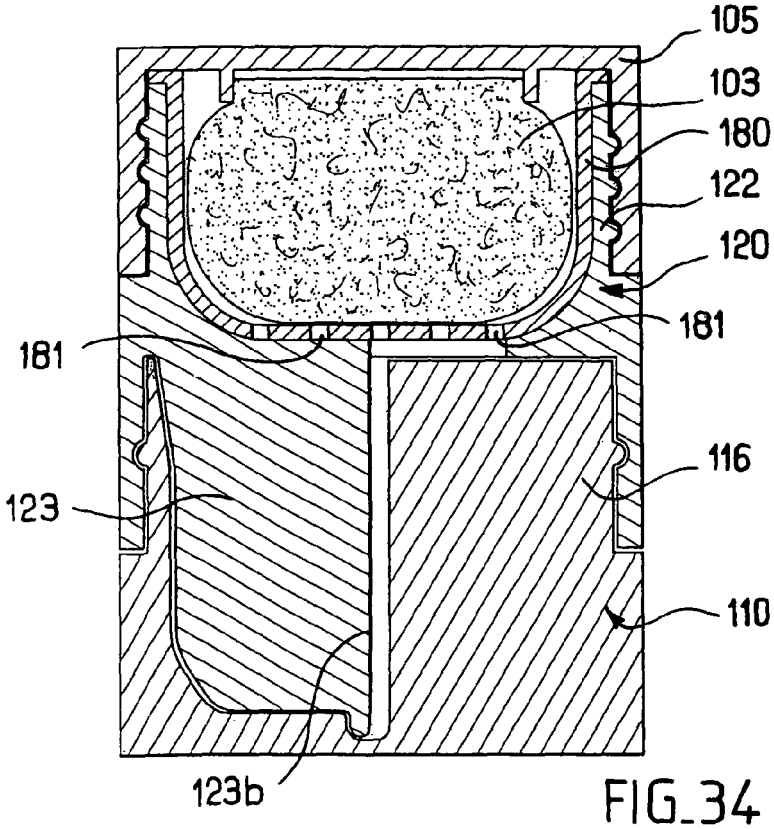

FIG. 34 shows the possibility of interposing a permeable wall 180, e.g. including a sieve or a grid, and defining at least one opening 181, better a plurality of openings 181, between the applicator element 103 and the inside space 115.

Figure 33:
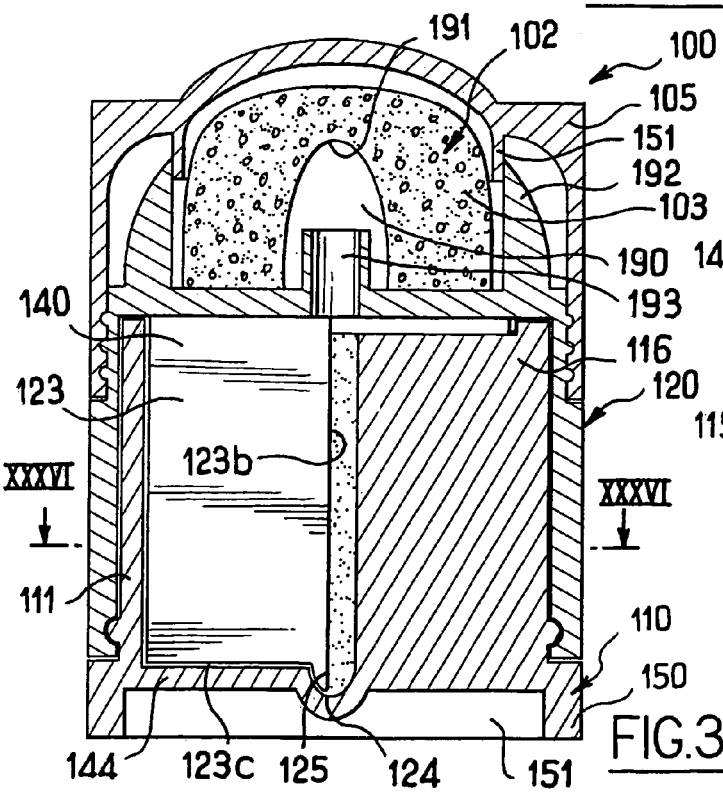
FIGS. 33 to 35 are diagrammatic axial section views of variants of the embodiment shown in FIG. 31.
Figure 36:
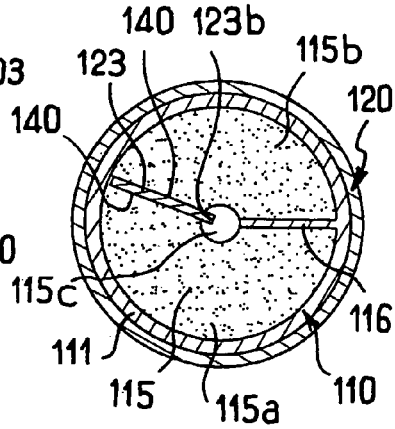
FIG. 36 is a cross-section view on XXXVI-XXXVI of FIG. 33.

In the example of FIG. 33, the applicator 102 is secured not to the closure cap 105, but to the second part 120.

In the example shown, the applicator element 103 comprises a foam, e.g. having a recess 190 defining an inside surface 191 arranged to receive the substance P when the second part 120 is turned.

The closure cap 105 may have an annular sealing lip 151 co-operating with a wall 192 of the second part 120 that extends around the applicator element 103.

FIG. 33 also shows that the cap 105 may present various shapes, and for example a top wall of a shape that matches the shape of the applicator element 103.

In the example of FIG. 33, the blade 123 is made with a portion 125 in relief, e.g. constituted by a stud, co-operating with a second portion 124 in relief, e.g. constituted by an indentation in the bottom wall 144 of the pot 111.

This bottom wall may be extended downwards at its periphery by a skirt 150 defining a housing 151, e.g. suitable for housing a mirror or a sample of substance. In the example shown, the bottom wall 144 presents a bulge in the housing 151 that enables the indentation 124 to be formed.

In the same manner as that described with reference to FIG. 31, the substance P is housed in the inside space 115 in two chambers 115*a* and 115*b* of the pot 111, which chambers are defined by the blade 123 and by the partition 116.

The substance P is expelled towards the applicator element when the blade 123 is turned in either direction by the user. A duct 193 can be formed integrally with the second part 120 to convey the substance P coming from the pot 111 towards the recess 190. The substance P coming into contact with the inside surface 191 of the applicator element 103 serves to feed the applicator element.

Figure 35:
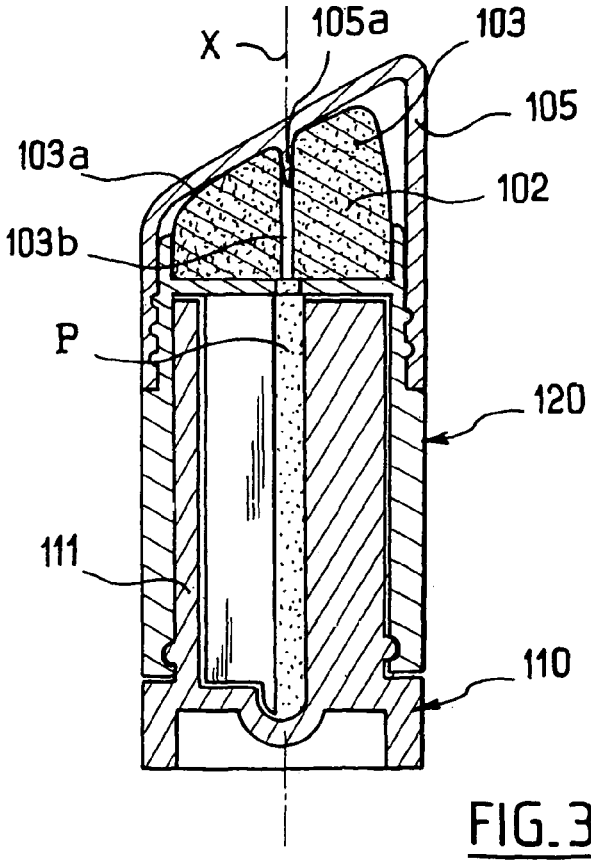

In FIG. 35, the applicator element 103 is intended to apply substance to the lips and presents a top face 103*a* that slopes relative to the axis of rotation X. This top face 103*a* may be fed with substance via a channel 103*b* passing through the applicator element 103. The channel 103*b* may be closed while the closure cap 105 is in place by a peg 105*a* of the cap.

Naturally, the invention is not limited to the embodiments described above.

In particular, the outside shape of the closure cap, of the first part 10, or of the second part 20 could be modified without thereby going beyond the ambit of the present invention.

By way of example, FIGS. 37 to 49 show various examples amongst others of possible shapes for the cap 5, for the first part 10, and for the second part 20.

The possible shapes may vary along the longitudinal axis Y or along any transverse axis, for example.

The shapes shown in FIGS. 37 to 49 are equally applicable to the embodiments of FIGS. 31 to 36, with the reference symbols 5, 10, and 20 being replaced by 105, 110, and 120, respectively.

Figure 37:
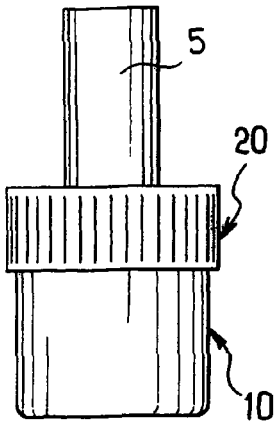

In the example of FIG. 37, the outer skirt of the second part 20 projects radially outwards from the first part 10.

Figure 38:
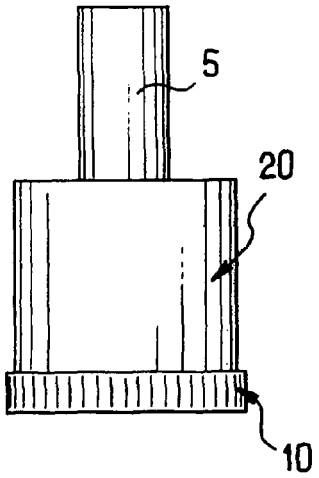

In the example of FIG. 38, it is the first part 10 that projects radially outwards relative to the second part 20.

Figure 39:
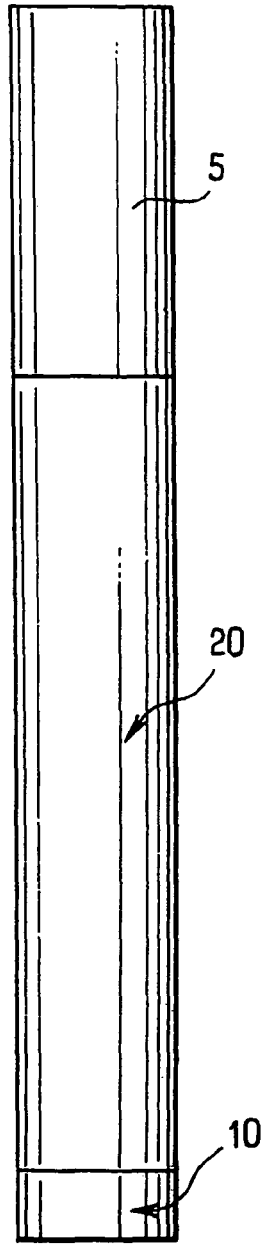
FIGS. 37 to 43 are elevation views showing additional examples of embodiments of the invention.

In the example of FIG. 39, the general shape of the device is clearly elongate, like a pen.

Figure 40:
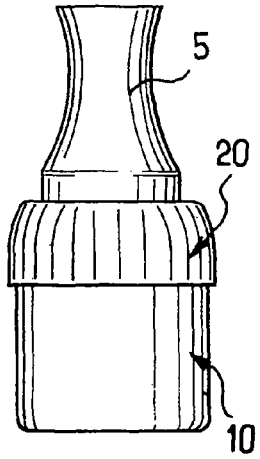

FIG. 40 shows that the closure cap 5 can be made with a shape that is outwardly concave, so as to make it easier to grasp.

Figure 41:
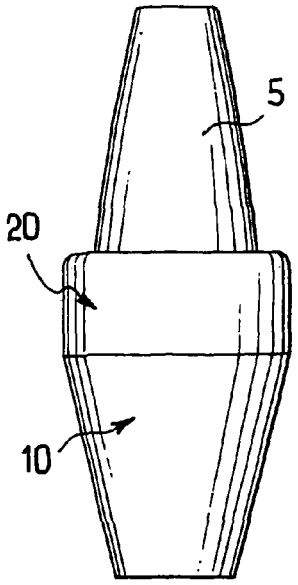

In FIG. 41, the closure cap 5 has the shape of a truncated bullet and the first part 10 is frustoconical in shape, with its outer cross-section tapering downwards.

Figure 42:
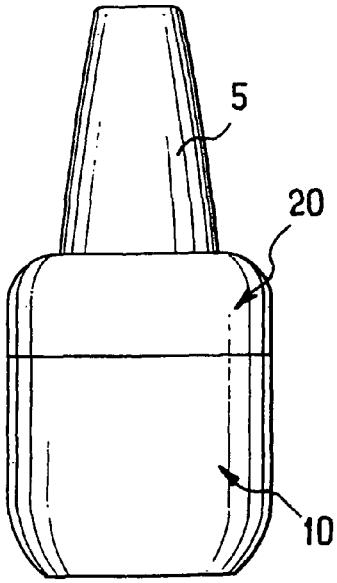

In FIG. 42, the first and second parts 10 and 20 have rounded edges.

Figure 43:
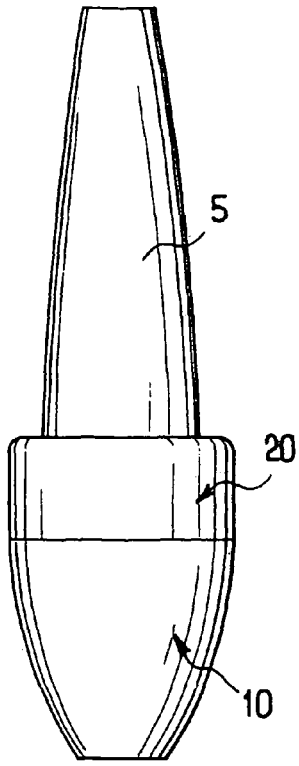

In FIG. 43, the height of the closure cap 5 is greater than the height of the first and second parts 10 and 20 when assembled together.

The first part 10 may have a double wall, with an outer wall 99 and an inner wall 11, e.g. presenting different bottom cross-sections.

Figure 44:
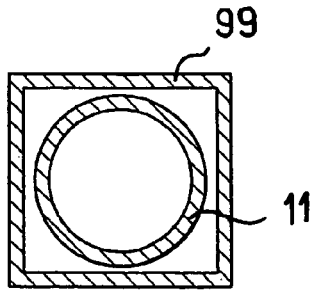
FIG. 44 is a cross-section showing in isolation the first part of a device in a variant embodiment.
Figure 45:
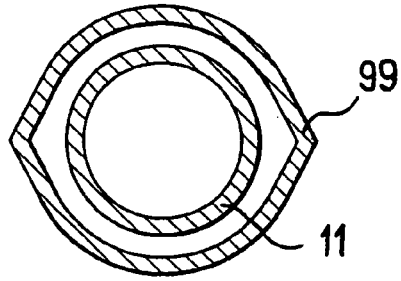
FIG. 45 is a view analogous to FIG. 44 showing another variant embodiment.

For example, the outer wall 99 may present a cross-section that is substantially square or rectangular, as shown in FIG. 44, or it may have some other shape, for example it may be lenticular, as shown in FIG. 45.

Figure 77:
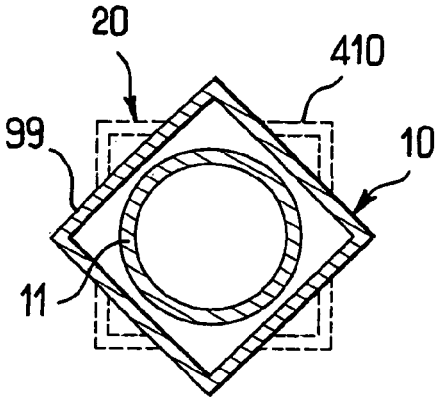
FIG. 77 is a cross-section view analogous to FIG. 44.

The second part 20 may also have a double wall, having an outer wall 410, and the outlines of the walls 99 and 410 may coincide in certain angular positions only of the first part relative to the second part, as shown in FIG. 77.

Figure 46:
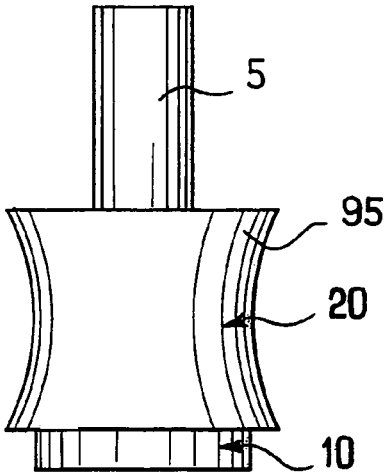
FIGS. 46 to 48 are elevation views of further variants.
Figure 47:
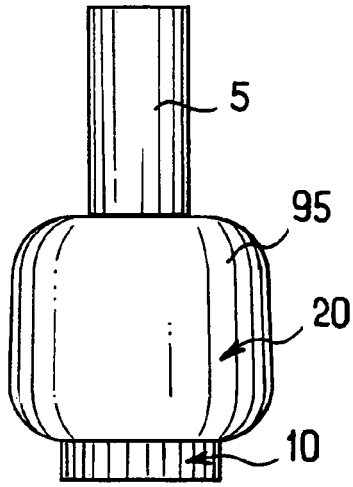

The second part 20 may have an outer covering 95, e.g. made of elastomer, as shown in FIGS. 46 and 47.

In FIG. 46, the outer covering 95 is in the form of a sleeve that co-operates, e.g. by friction, with the outer skirt 21 that is not visible in this figure. By way of example, the sleeve may have an outwardly concave axial section over its entire circumference.

In FIG. 47, the outer covering 95 is likewise in the form of a sleeve, which may be generally outwardly convex in shape.

Figure 48:
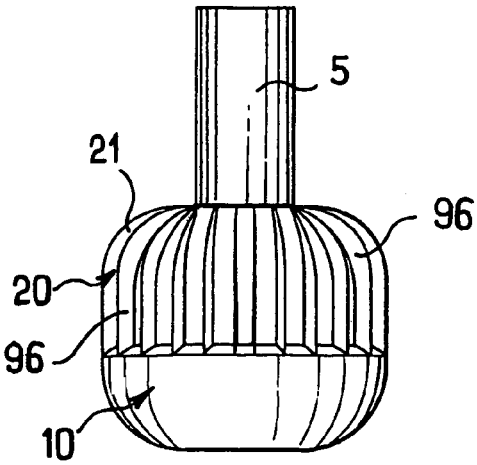

Portions in relief may be formed on the outer skirt 21 of the second part 20, e.g. fins 96 as shown in FIG. 48.

Figure 49:
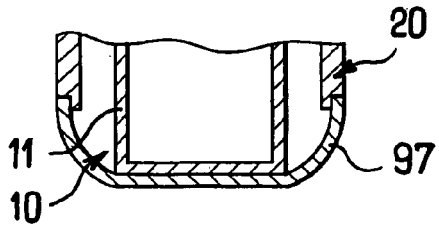
FIG. 49 is a diagrammatic and fragmentary axial section view of an additional variant.

It is also possible to cover one and/or the other of the first and second parts 10 and 20 with a double wall 97, as shown in FIG. 49, thus giving the impression of volume.

Figure 50:
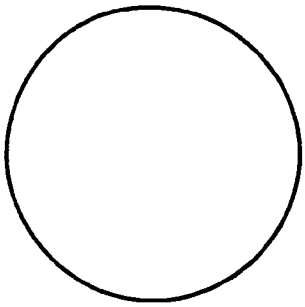
FIGS. 50 to 53 are diagrams showing examples of cross-sectional shapes for the receptacle.
Figure 51:
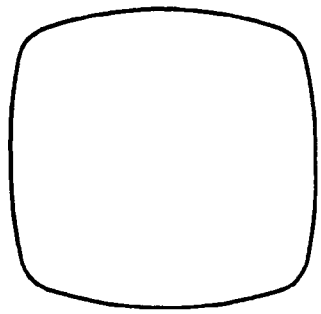
Figure 52:
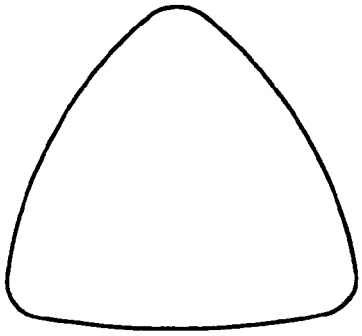
Figure 53:
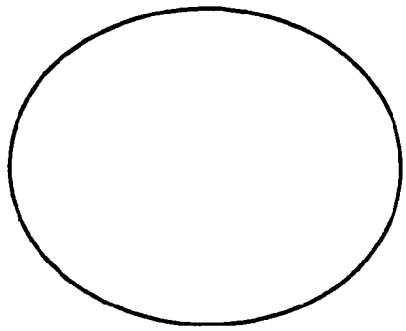

The cross-section of the first and/or second part may present a variety of shapes at least one point along the axis Y, for example it may be generally circular as shown in FIG. 50, substantially square, possibly with rounded corners, as shown in FIG. 51, substantially triangular as shown in FIG. 52, e.g. with rounded corners, or indeed substantially oval, as shown in FIG. 53.

Within a single device, the cross-section of the first and/or the second part may vary along the longitudinal axis X.

Figure 54:
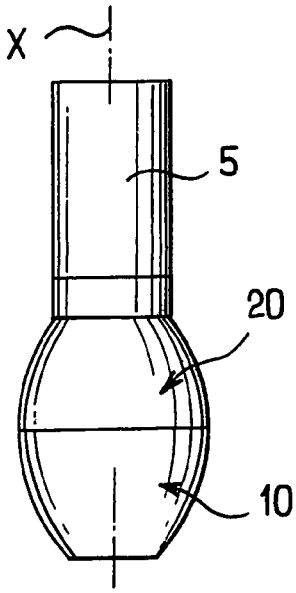
FIG. 54 is a diagrammatic elevation view of another variant embodiment.

By way of example, FIG. 54 shows a device in which the cross-section goes from being oval in shape at its bottom end to being circular in shape at the junction between the first part 10 and the second part 20, and subsequently returning to an oval shape towards the top of the receptacle, under the closure cap 5.

Such variation in the shape of the cross-section of the receptacle while having a circular junction between the first and second parts can make it possible to provide a receptacle of original shape without harming sealing, and can make it easier to grasp the first and second parts in order to turn one relative to the other.

Figure 55:
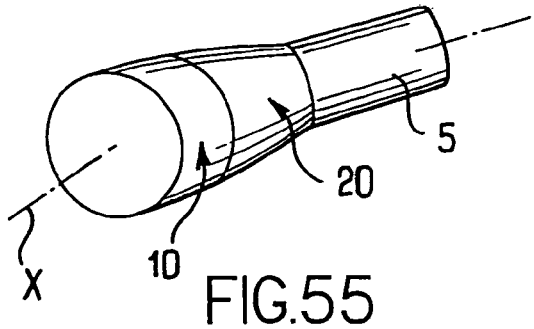
FIG. 55 is a diagrammatic side view in perspective of another variant.

In FIG. 55, the first part 10 presents a cross-section that is generally circular, and in cross-section at the bottom end of the second part 20 changes towards a shape that is substantially square at the top of the receptacle under the cap 5.

Whatever the shape of the receptacle, the closure cap 5 may include a locking system enabling it to be held substantially stationary relative to one of the first and second parts. Because of the locking system, the cap 5 does not become unscrewed when the first part 10 turns relative to the second part 20. This can make it easier for the user to turn one of the parts.

Figure 80:
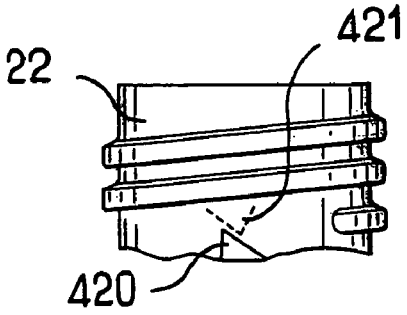
FIG. 80 shows how the neck can be made with means for preventing the closure cap becoming unscrewed.

By way of example, and as shown in FIG. 80, the locking system may comprise a pawl 421 that snaps against a ratchet formed in one of the first and second parts when the closure cap 5 is screwed home.

In order to unscrew the closure cap, the pawl must escape from the ratchet 420 in the opposite direction. The force that must be exerted in order to enable the pawl to escape in the opposite direction can be greater than the force needed to turn one of the parts relative to the other. Thus, the user can make use of the closure cap as a handle for causing the first part to turn relative to the second part in one direction only or in a plurality of back-and-forth movements, depending on the desired result. Thereafter, in order to proceed with application, the user can turn the cap more strongly while holding the two parts 10 and 20 stationary relative to each other so as to cause the pawl to escape from the ratchet. Where appropriate, some additional action may need to be exerted on the cap in order to make it possible and/or easier to cause the pawl to escape from the ratchet, e.g. a force may be exerted axially on the cap, depending on the configuration of the ratchet and of the closure cap.

Figure 56:
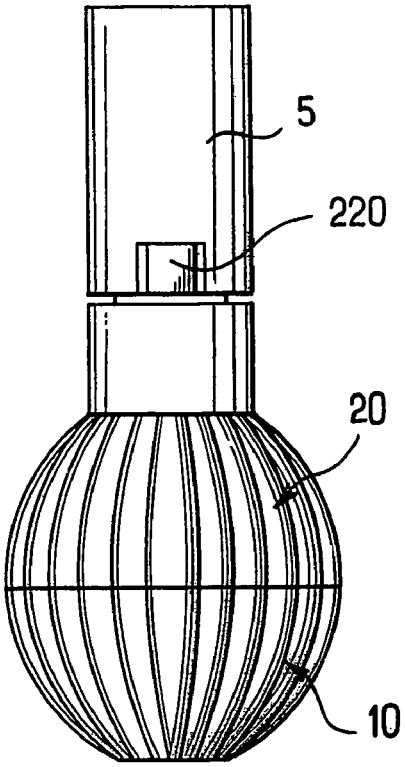
FIGS. 56 and 57 are diagrammatic elevation views of another variant embodiment.
Figure 57:
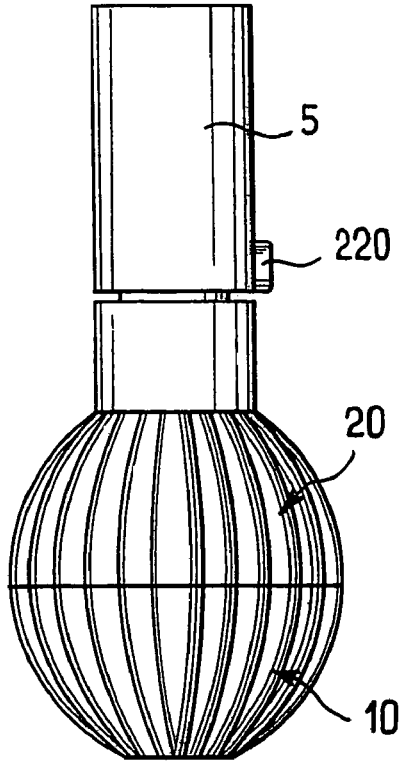

In a variant shown in FIGS. 56 and 57, the locking system includes a pushbutton 220 on the closure cap, or in a variant (not shown) on one of the first and second parts, serving optionally to secure the closure cap in rotation together with one of the first and second parts.

When the user presses the pushbutton 220 and turns the second part 20 relative to the first part 10, the closure cap 5 remains secured to one of the parts and does not become unscrewed.

Figure 58:
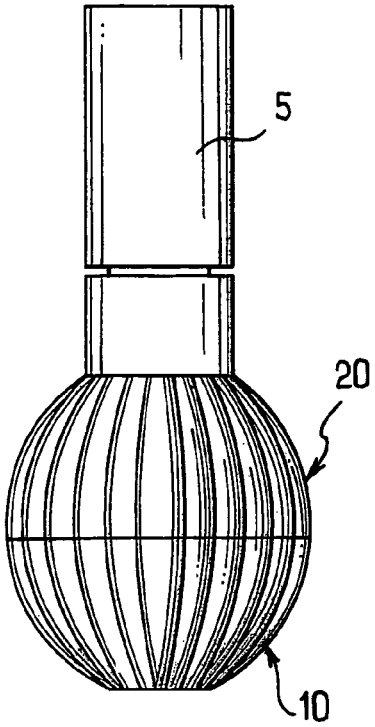
FIG. 58 is a diagrammatic elevation view of another variant.
Figure 59:
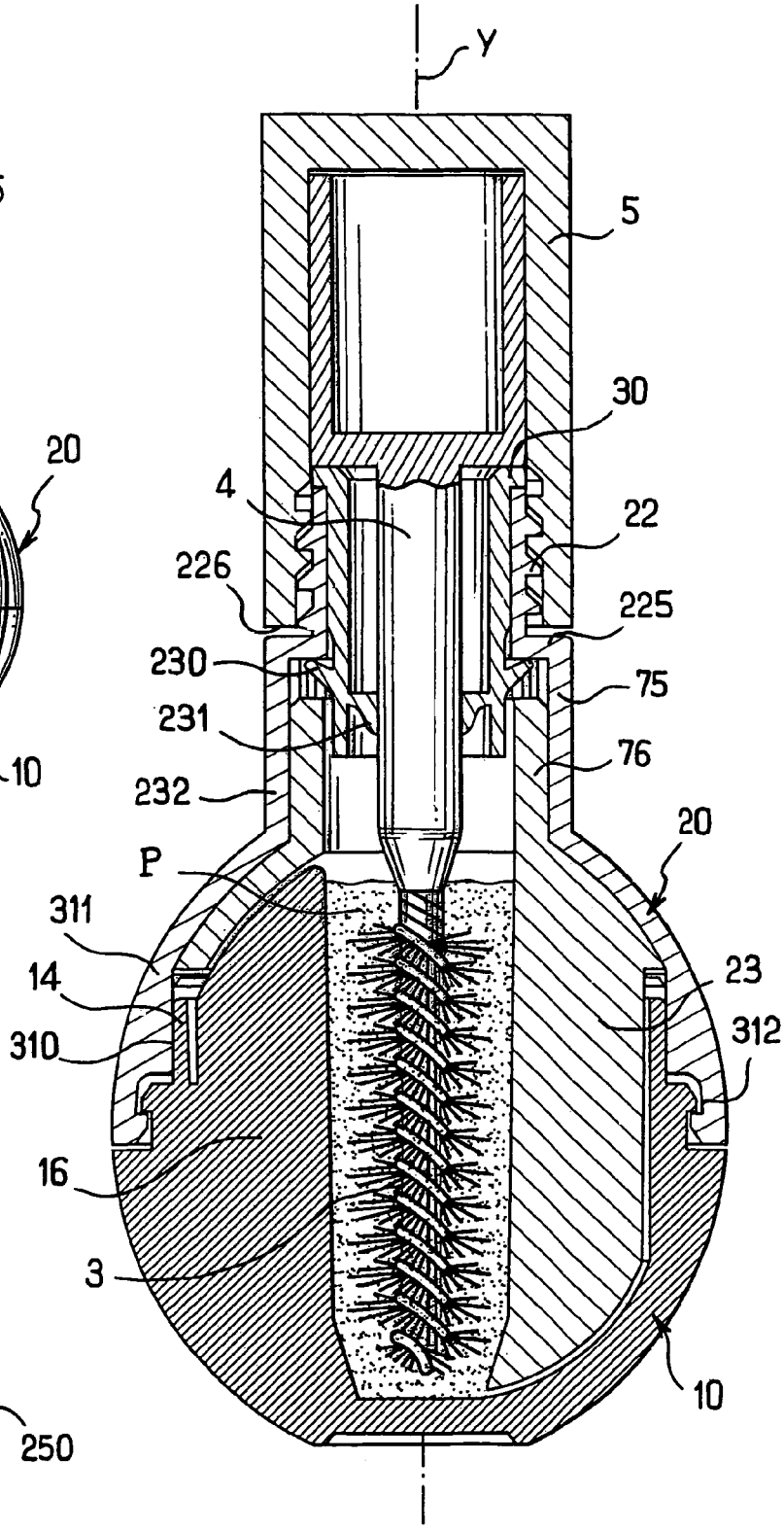
FIG. 59 is a diagrammatic axial section view of the FIG. 58 device.

FIGS. 58 and 59 show another embodiment of a device of the invention in which the receptacle presents broad longitudinal ribs on the outside.

The second part 20 has an outer portion 75 with a neck 22 having an outside thread, onto which the closure cap 5 can be screwed.

The bottom of the neck 22 is connected to a shoulder 225.

The wiper member 30 rests on the top edge of the neck and presents an annular holding lip 230 that bears against the underside of the shoulder 225.

The wiper member 30 has a wiper lip 231 extending inwards and, in the example shown, with the device being in the closed position, it bears against the stem 4 of the applicator 2.

The outer portion 75 has a generally cylindrical portion 232 extending downwards under the shoulder 225 in line with the closure cap 5.

This cylindrical portion 232 may be fluted internally so as to make it easier to keep the inner portion 76 firmly secured against moving inside the outer portion 75, e.g. with clamping in the cylindrical portion 232.

The inner portion 76 carries the blade 23 in the example described.

The bottom of the generally cylindrical portion 232 is connected to a portion 311 of generally hemispherical shape, presenting a circularly cylindrical surface 310 against which a sealing lip 14 of the second part 10 can bear.

As shown, the portion 311 may include an internal angular groove 312 into which the first part 10 can snap-fasten.

The first part 10 is made as a single piece in the example shown, e.g. by molding a plastics material.

By way of example, the applicator element 3 is a mascara brush, but it could be any other type of applicator element without going beyond the ambit of the invention.

Figure 60:
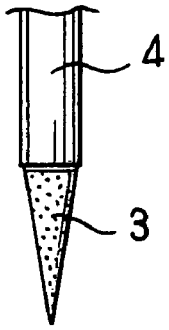
FIG. 60 is a diagrammatic and fragmentary view of another example of an applicator element.

By way of example, the applicator element 3 may be an endpiece presenting a greatest transverse dimension that is less than the diameter of the rod, as shown in FIG. 60.

Figure 61:
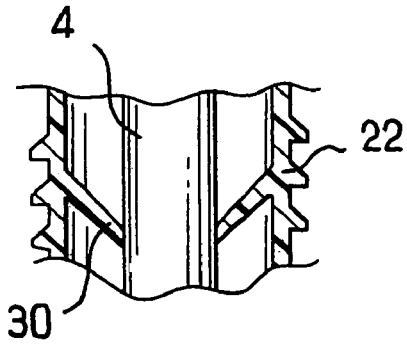
FIG. 61 is a diagrammatic and fragmentary view showing an example of a wiper member.

As shown in FIG. 61, the wiper member 30 may have a wiper lip made integrally with the neck 22 and extending inside the lip in order to perform its wiping function.

Figure 62:
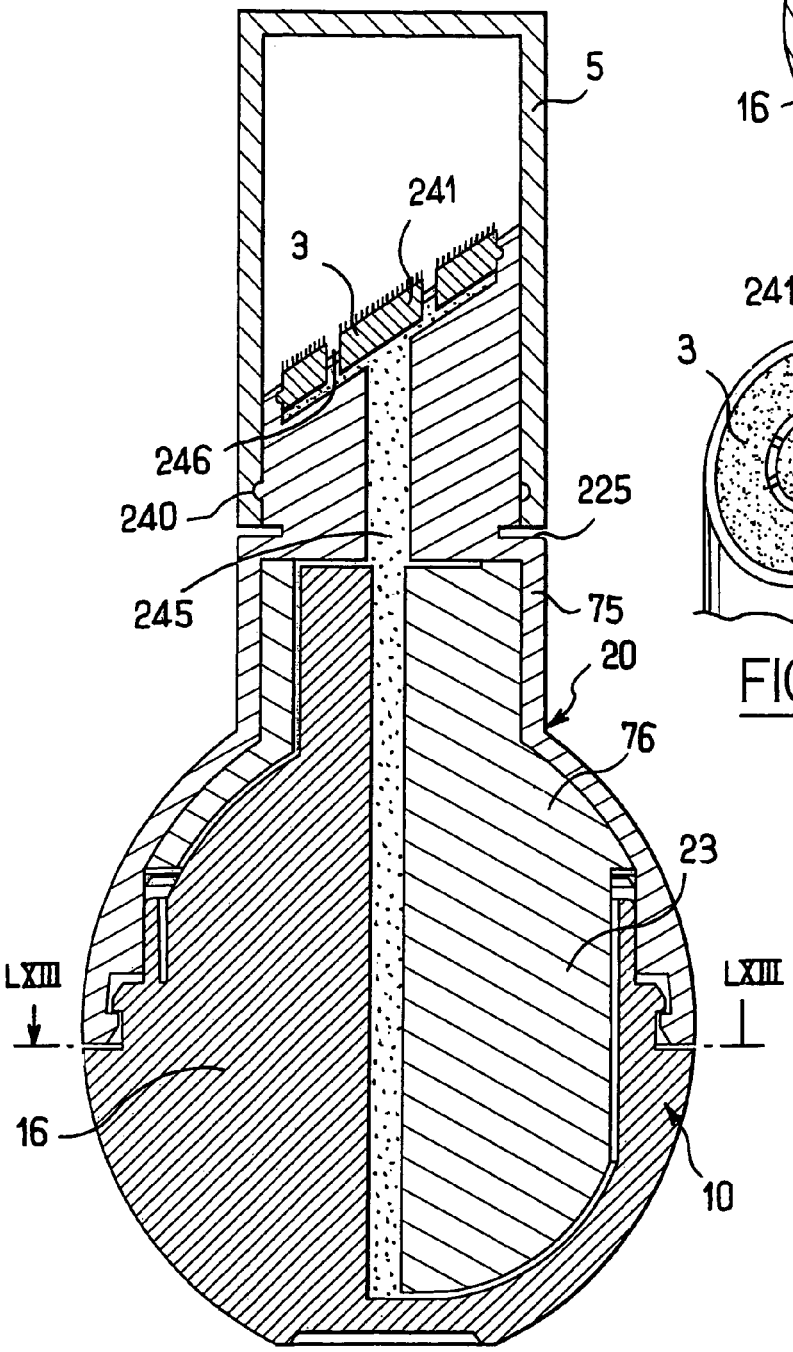
FIG. 62 is a diagrammatic axial section view of another variant embodiment.
Figure 63:
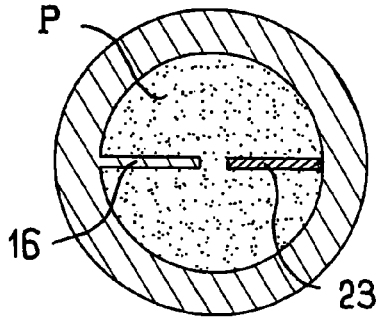
FIG. 63 is a cross-section on LXIII-LXIII of FIG. 62.

In the embodiment of FIG. 62, the device presents an outside shape similar to the device of FIG. 59, but it could present some other shape.

The device of FIG. 62 is for applying a substance that is liquid or that presents some other constituency, e.g. lipstick, and the applicator element 3 is permanently secured to the second part 20.

By way of example, the applicator element 3 comprises a flocked grid 241 secured to the top end of the neck, which neck may have an outside bead 240 onto which a corresponding annular groove of the closure cap 5 snap-fastens.

The grid 241 is preferably disposed at an angle in order to make it easier to apply the substance to the lips, for example.

Figure 64:
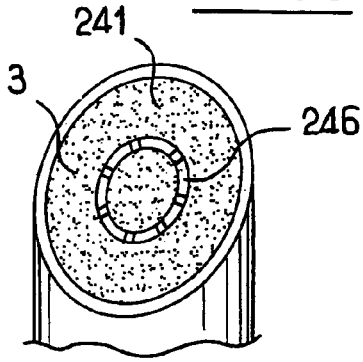
FIG. 64 is a diagrammatic perspective view of the applicator element of the FIG. 62 device.

On turning the first part 10 relative to the second part 20, the substance is brought towards the applicator element 3 via a chimney 245, and it moves to the outside through an annular groove 246 that can be seen more clearly in FIG. 64.

Figure 65:
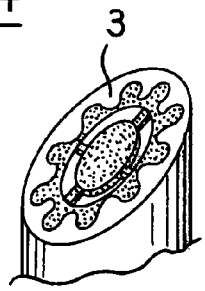
FIGS. 65 and 66 are diagrammatic perspective views of other examples of applicator elements.

The grid 241 may present a variety of shapes, and it may optionally be flocked in full or in part, as shown in FIG. 65.

Figure 66:
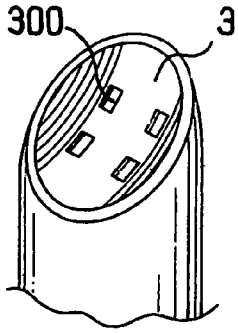

The applicator element 3 may comprise an elastomer, e.g. a thermoplastic elastomer, that is provided with one or more orifices 320, as shown in FIG. 66.

Figure 67:
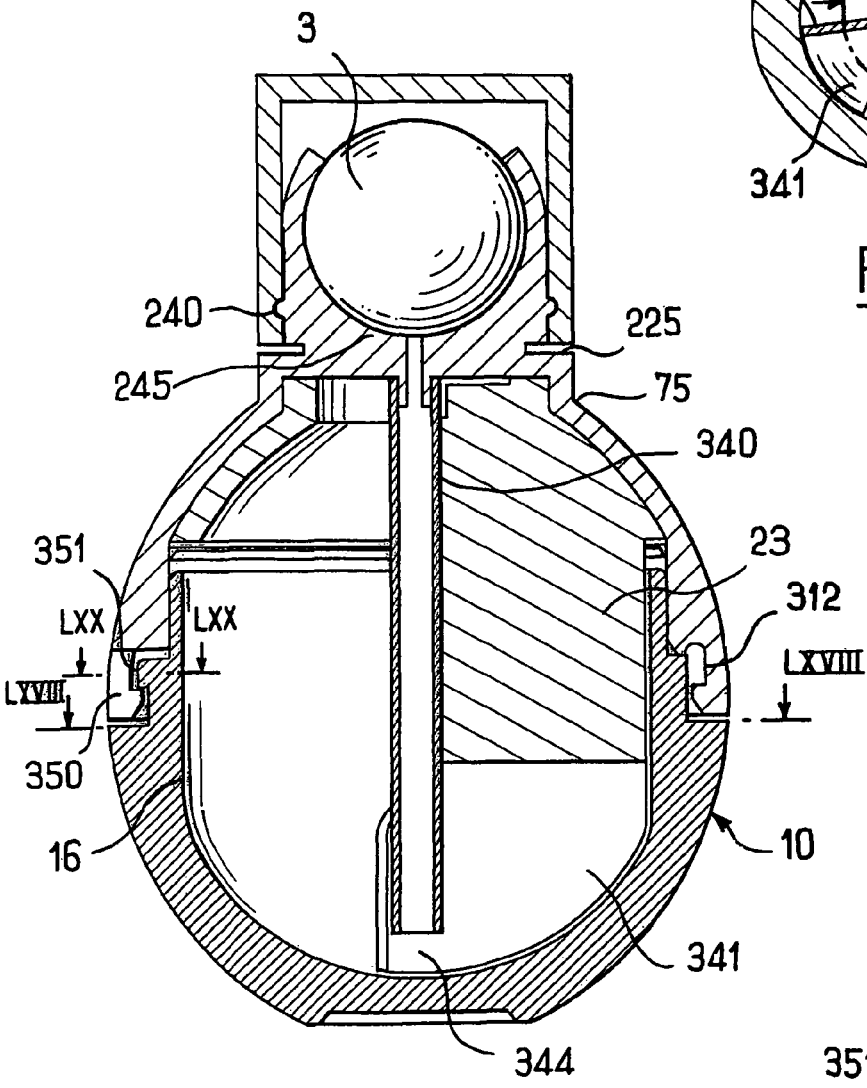
FIG. 67 is a view analogous to FIG. 62 showing a variant embodiment.
Figure 68:
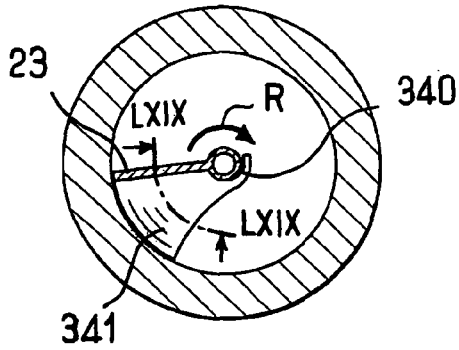
FIG. 68 is a fragmentary and diagrammatic section view on LXVIII-LXVIII of FIG. 67.
Figure 69:
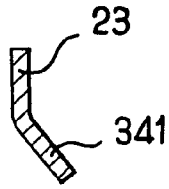
FIG. 69 is a longitudinal section view of LXIX-LXIX of FIG. 68, showing the blade.
Figure 70:
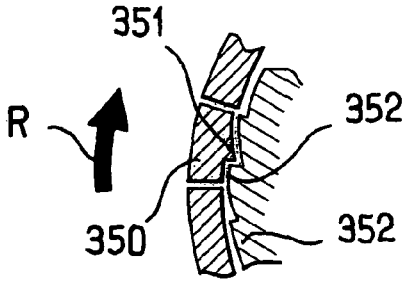
FIG. 70 is a fragmentary and diagrammatic cross-section on LXX of FIG. 67.

The device shown in FIG. 67 has a dip tube 340 communicating at the top with an applicator element 3 that comprises a ball, but that could be replaced by any other dispensing means, e.g. an optionally flocked endpiece, a foam, a felt, etc.

By way of example, the second part 20 has a blade 23 with a bottom portion 341 that is curved simultaneously downwards, inwards, and rearwards, given the direction of rotation of the blade 23 as represented by the arrow, such that turning the blade 23 expels the substance towards a central region 344 into which the bottom of the dip tube 340 opens out.

In order to ensure that the parts turn relative to each other in a determined direction R, an elastically deformable tab 350 carrying a pawl 351 can be made with the second part 20, for example, the pawl 351 pressing against ratchets 352 configured in such a manner as to prevent turning in the opposite direction.

In the example described, the ratchets 352 are made so as to extend in the annular groove 312 of the second part.

Figure 71:
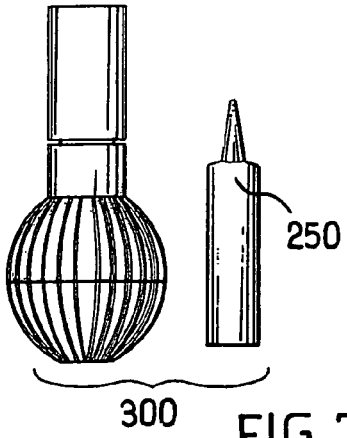
FIG. 71 is a diagram of a kit constituting an embodiment of the invention.

As shown in FIG. 71, any appropriate device as described above can be accompanied in a kit 300 by a tube 250 or other receptacle containing at least one additional component, e.g. a solvent, e.g. for adding at the time the substance contained inside the device is used.

Turning the first part 10 relative to the second part 20 then makes it possible to mix the substance with the component as inserted in this way and to make the mixture uniform.

This makes it possible, for example, to add an oil to a lipstick that was poured in while hot when filling the device.

It would not go beyond ambit of the present invention for the blade 23 and/or the partition 16 to be of some other shape. In particular, the thickness of the blade 23 and/or of the partition 16 could be different. For example, the blade 23 and/or the partition 16 could present a cross-section of shape that is generally triangular, rectangular, or other.

Nor would it go beyond the ambit of the present invention for the applicator element to present some other shape, for example it could be in the form of a paintbrush, a comb, or in some other form.

By way of example, FIGS. 72 to 76 show other examples of applicator elements.

Figure 72:
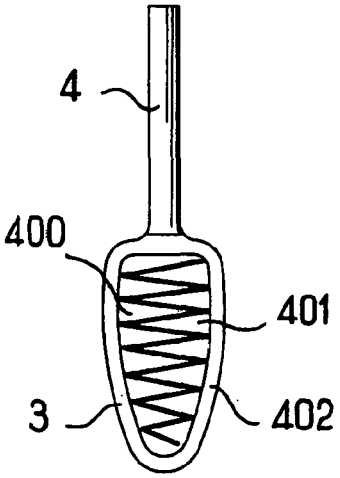
FIGS. 72 to 76 are fragmentary and diagrammatic views in elevation of other examples of applicator elements.
Figure 73:
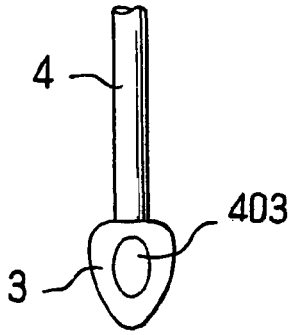

For example, the applicator element may be hollow as is shown in the examples of FIGS. 72 and 73.

FIG. 72 shows a comb for the eyelashes or the eyebrows which comprises, for example, two series of teeth 400, 401 that are inter-engaged and that have their bases connected to a frame 402.

The applicator element 3 of FIG. 72 is made, for example, in accordance with US patent application No. 2002/0005209, the content of which is incorporated herein by reference.

In FIG. 73, the applicator element 3 has a central cavity 403. This cavity can become filled with substance when the first and second parts of the receptacle are turned relative to each other.

Figure 74:
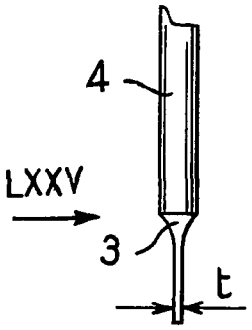
Figure 75:
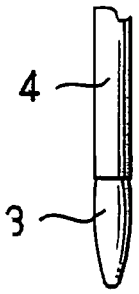

In FIGS. 74 and 75, there can be seen an applicator element 3 that is generally flat in shape, having thickness t that is less than the diameter of the stem 4, for example, so that the substance can remain present on each of the main faces of the applicator element 3 after it has been withdrawn and passed through a wiper member.

Figure 76:
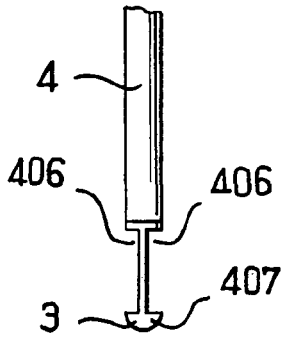

The applicator element 3 shown in FIG. 76 does not have a through cavity, but does have at least one cavity 406 in one of its main faces, and specifically it has two opposite cavities 406. The applicator element 3 has an enlarged distal end 407 of maximum transverse dimension that corresponds substantially to the diameter of the stem 4, for example. Substance can accumulate in each of the cavities 406, even when the applicator element 3 passes through a wiper member of diameter that substantially matches the diameter of the stem 4.

Figure 78:
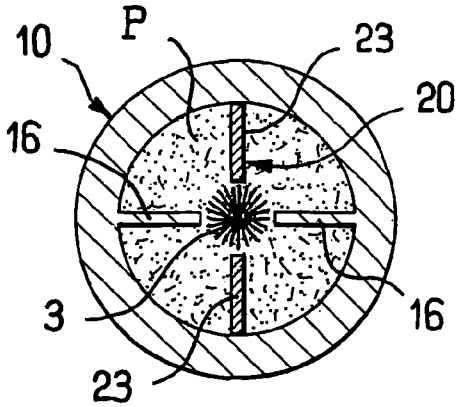
FIG. 78 is a cross-section view analogous to FIG. 4.

One of the parts 10 and 20 may have a plurality of blades 23, e.g. two diametrically opposite blades 23, as shown in FIG. 78, while the other part may have a plurality of partitions 16, e.g. two diametrically opposite partitions 16. The shapes of the blades and the partitions may be arbitrary, for example they may have one or more openings and they may be plane or otherwise.

Figure 79:
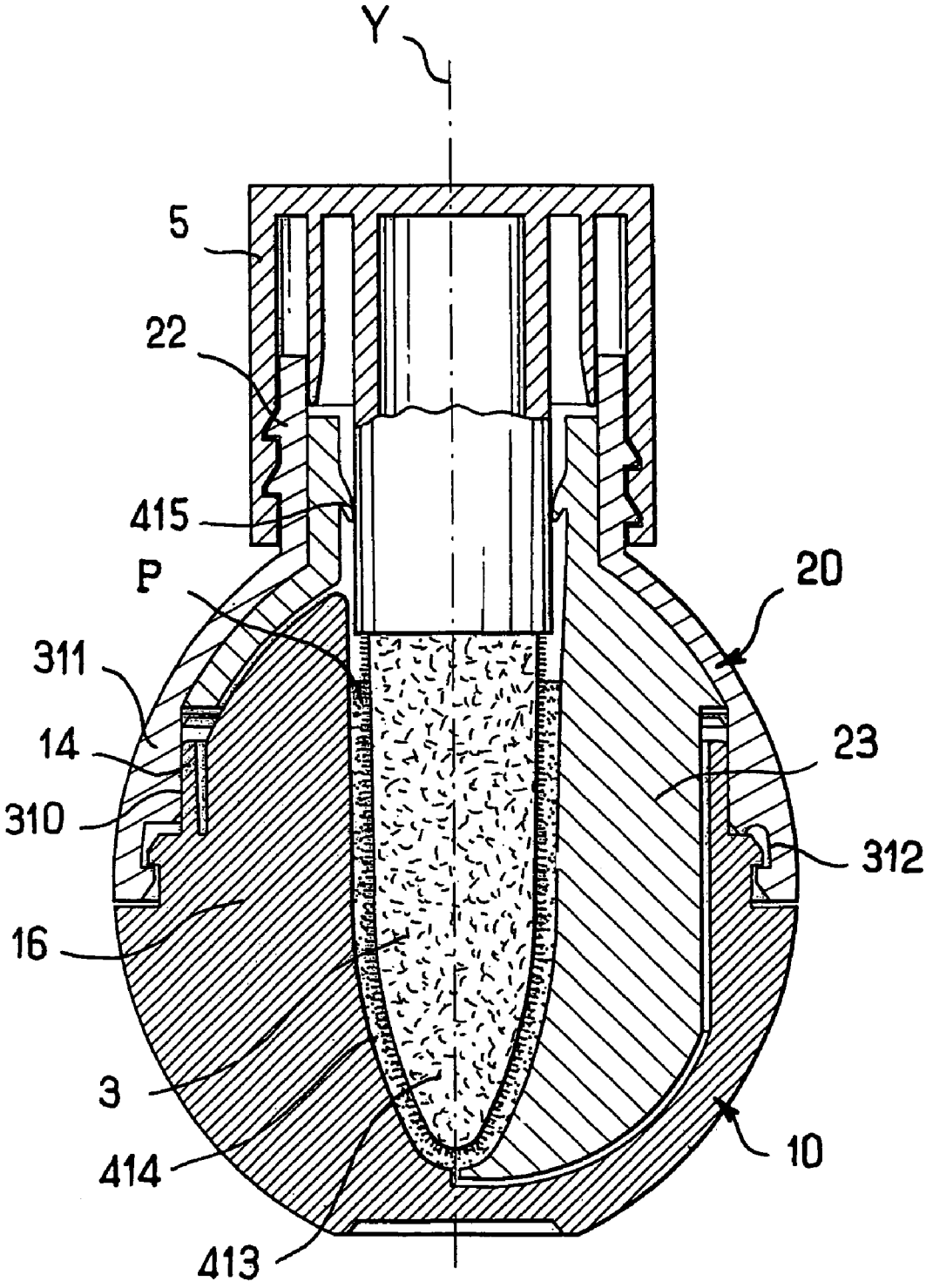
FIG. 79 is a fragmentary and diagrammatic longitudinal section view of a device constituting another embodiment of the invention.

FIG. 79 shows a device that differs from that shown in FIG. 59 in particular in that it includes an applicator element 3 made up of an endpiece for application on the lips or the skin, and optionally coated in flocking 413.

A gap 414 is left around the applicator element 3 so that after the parts have been turned relative to each other, a film of substance remains around the applicator element 3, which film can be relatively thick.

The neck may include a wiper lip 415. This lip may be made integrally with the blade 23, or in a variant it may be constituted by a separate fitted piece. The device may contain a plurality of phases of substance that need to be mixed together prior to use.

The wiper lip 415 may also be omitted.

Figure 81:
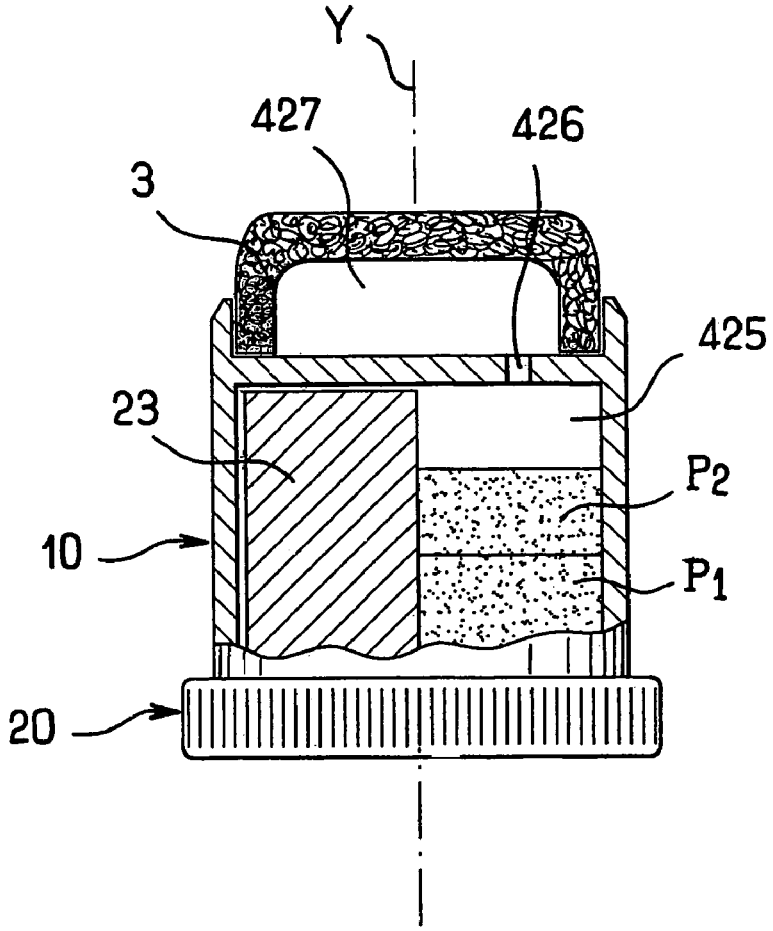
FIG. 81 is a diagrammatic longitudinal section view showing another embodiment of the invention.

FIG. 81 shows that it is possible for the device to include an inside space 425 provided with an outlet orifice 426 that is off-center relative to the axis of rotation Y. This orifice 426 may open out into an inside cavity 427 in order to feed an applicator element 3, which element may comprise, for example, a wall made of a material that is permeable to the substance.

The inside space 425 may contain, for example, a plurality of phases P1, P2 that need to be blended into a uniform mixture at the moment of utilization by turning the second part 20 relative to the first part 10.

The various phases may be cast in succession while the device is being filled.

The device of FIG. 81 may have at least one blade 23 and a backing blade (not shown in the drawings), for example, or it may have only one blade which on being turned serves to make the content of the device uniform, and where appropriate also serves to encourage it to pass through the orifice 426, or forces it therethrough.

Figure 82:
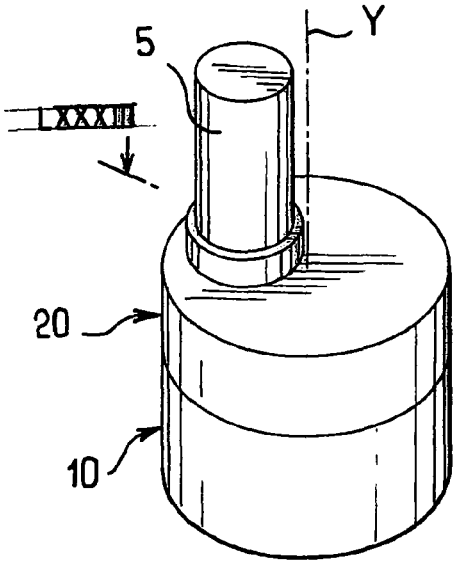
FIG. 82 is a diagrammatic perspective view of a device constituting another embodiment of the invention.
Figure 83:
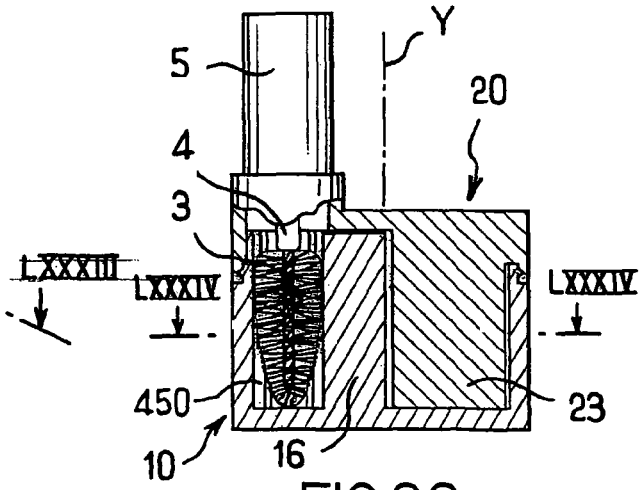
FIG. 83 is a longitudinal section view on LXXXII-LXXXII of FIG. 82.
Figure 84:
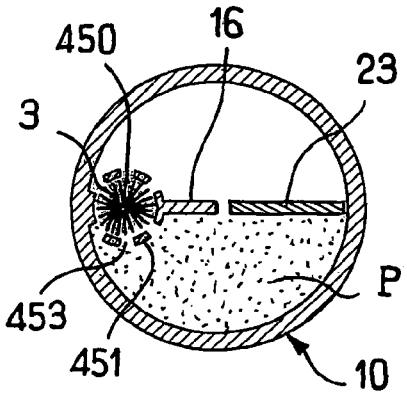
FIG. 84 is a diagrammatic cross-section view on LXXXIV-LXXXIV of FIG. 83.

FIGS. 82 to 84 show a device constituting another embodiment of the invention.

In this device, the applicator is off-center relative to the axis of rotation Y. The applicator includes an applicator element 3, e.g. a brush as in the example shown, which element is received in an off center housing 450. By way of example, the housing may have a perforated wall 451 so as to allow the substance P to pass therethrough when the blade 23 driven by the second part 20 turns inside the device.

By way of example, the wall 451 may have a series of longitudinal slots 453.

Figure 85:
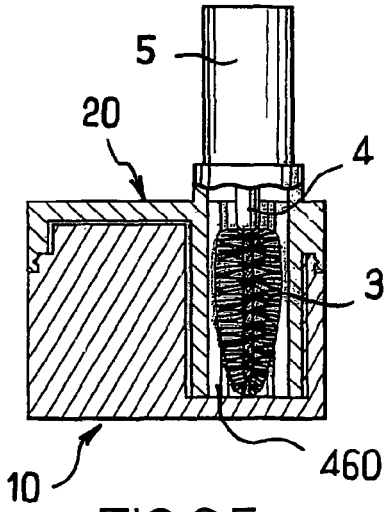
FIG. 85 is a view analogous to FIG. 83 showing a variant embodiment.
Figure 86:
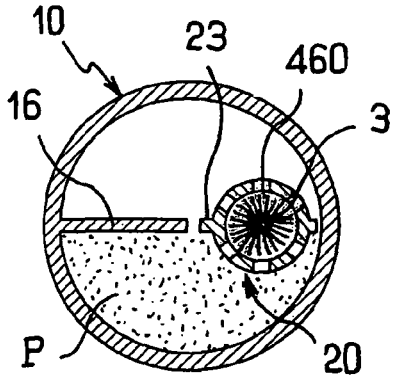
FIG. 86 is a section view analogous to FIG. 84 showing a variant of FIG. 85.

The housing 450 could also be made differently and the wall 451 could have different perforations. In the variant shown in FIG. 85, the housing 460 receiving the applicator element 3 is made integrally with the blade 23 and turns together therewith relative to the first part 10.

Figure 87:
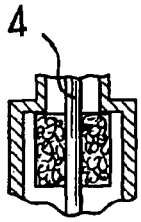
FIG. 87 is a fragmentary longitudinal section view showing a variant embodiment of the wiper member.

If so desired, and in any of the devices, the wiper member may be made using a porous material that is elastically deformable, such as a block of open-celled foam, as shown in FIG. 87.

The characteristics of the various embodiments of the invention can be combined with one another in variants that are not shown.

All types of material can be used for making the various portions of the device, in particular the first and second parts and the cap, in particular they can be made of glass, metal, wood, plastic materials, singly or in combination, so as to obtain the required conservation of the substance.

The substances contained in the device may be care substances, makeup, dermatological substances, hair care substances, for example.

The invention makes it possible to mix substances that are not miscible or that are traditionally not used in such applications because they comprise two or three phases to be mixed together.

The device enables the mixture to be made uniform by turning the first and second parts relative to each other. Thus, new substances can be used, e.g. for makeup, providing new makeup effects, or better staying power, or other properties that are new or improved.

A substance that is pasty or even solid can be cast while hot or cold into the device during initial filling, for example, and then some other substance can be added, as mentioned above, and in particular a liquid, e.g. a silicone gum, a silicone oil, or polybutylene, with the substances being mixed together by the device in order to deliver a final substance that is uniform.

A plurality of ingredients that are unstable and/or incompatible can be introduced while hot or cold into the device during its initial filling or subsequently, thus making it possible to obtain substances delivered by the device that have rheology or other properties that are difficult to obtain otherwise.

The substance contained in the device may be heated prior to use, e.g. in a microwave oven, in order to improve the behavior of the substance, for example. Moving the two parts of the receptacle relative to each other can make it possible to achieve a uniform temperature prior to application.

Throughout the description, including in the claims, the term "comprising a" should be understood as being synonymous with "comprising at least one" unless specified to the contrary.

What is claimed is:

1. A device for packaging and applying a substance, the device comprising:

a receptacle for containing the substance, the receptacle comprising a first part and a second part, the second part being turnable by a user relative to the first part; and an applicator;

the second part including a blade defining a rotary surface in contact with the substance inside the receptacle and having a shape that is curved in such a manner as to deflect the substance toward a center of the receptacle and the applicator when said blade is turned in an appropriate direction, a radially inner edge of the blade being situated in a central region of an inside space of the receptacle for containing the substance, said rotary surface including a bottom edge that matches substantially a shape of a bottom wall of the receptacle, the turning of said rotary surface being enabled regardless of a position of the applicator with respect to the receptacle, including when the device is in a closed position.

2. A device according to claim 1, wherein the applicator is located at the center of the receptacle.

3. A device according to claim 1, wherein the first and second parts co-operate by snap-fastening.

4. A device according to claim 1, wherein the first part defines an inside space for containing the substance.

5. A device according to claim 4, wherein said rotary surface extends substantially to a wall of the first part defining the inside space.

6. A device according to claim 1, wherein the second part includes an outer skirt turnable by the user relative to the first part.

7. A device according to claim 1, wherein the second part includes a neck.

8. A device according to claim 7, wherein the neck is threaded.

9. A device according to claim 1, wherein said rotary surface extends at least in part parallel to the axis of rotation of the second part.

10. A device according to claim 1, wherein said rotary surface includes a radially outer edge that matches substantially the shape of a side wall of the receptacle.

11. A device according to claim 1, wherein the second part is made as a single piece out of a plastics material.

12. A device according to claim 1, wherein the first and second parts are made of different materials.

13. A device according to claim 1, wherein the ratio h/d of a height h of the receptacle divided by the greatest transverse dimension d of the receptacle lies in the range of about 0.1 to about 10.

14. A device according to claim 1, wherein the substance is contained in an inside space of the receptacle and wherein the ratio $h_i/d$ of the height $h_i$ of said inside space divided by a greatest transverse dimension d of the receptacle lies in the range of about 0.1 to about 10.

15. A device according to claim 1, wherein the applicator is removable.

16. A device according to claim 1, wherein the applicator is secured to a closure cap.

17. A device according to claim 16, wherein the applicator extends inside the receptacle when the closure cap is in place on the receptacle.

18. A device according to claim 17, wherein the applicator includes a stem extending substantially parallel to an axis of rotation of the second part.

19. A device according to claim 18, wherein the stem includes a narrow portion that is positioned in register with the wiper member in the storage configuration.

20. A device according to claim 18, wherein the stem is made out of at least one of polyethylene, polypropylene, polyamide, polyacetyl, polyethylene terephthalate, sytrene acrylonitrile copolymer, polystyrene and acrylonitrile-butadiene-sytrene copolymer.

21. A device according to claim 1, wherein the applicator includes a brush.

22. A device according to claim 1, wherein the applicator comprises an applicator element which extends along a longitudinal axis that makes an angle with the longitudinal axis of a stem that the applicator element.

23. A device according to claim 1, wherein the applicator comprises an applicator element that is not a brush.

24. A device according to claim 23, wherein the applicator element comprises at least one of a comb, a felt, a flocked element and a foam.

25. A device according to claim 23, wherein the applicator is configured to apply a substance to the skin.

26. A device according to claim 25, wherein the applicator comprises a flocked foam.

27. A device according to claim 1, further comprising containing a fluid substance contained by the receptacle, the fluid substance being one of creamy, gelled, and pasty consistency.

28. A device according to claim 1, wherein the second part is made out of at least one of polyethylene, polypropylene, polyamide, polyacetyl, polyethylene terephthalate, sytrene acrylonitrile copolymer, polystyrene and acrylonitrile-butadiene-sytrene copolymer.

29. A device according to claim 1, wherein the first part is made out of at least one of polyethylene, polypropylene, polyamide, polyacetyl, polyethylene terephthalate, sytrene acrylonitrile copolymer, polystyrene and acrylonitrile-butadiene-sytrene copolymer.

30. A device according to claim 29, wherein the first part and the second part are made of different materials.

31. A device according to claim 1, further comprising a wiper member made out of at least one of polyethylene, polypropylene, polyacetyl, polyethylene terephthalate, sytrene acrylonitrile copolymer, polystyrene, acrylonitrile-butadiene-sytrene copolymer, nitrile, silicone, ethylene polypropylene diene, sytrene-isoprene-sytrene, sytrene ethylene polypropylene butadiene-sytrene, thermoplastic polyester elastomer, thermoplastic elastomer, polyurethane foam, polyester foam, and polyether foam.

32. A device according to claim 1, wherein the substance is selected from the following: mascara, eye shadow, lipstick, eye liner, a care product, a foundation, a dermatological product, a hair-care product, a self-tanning product, a lip-care product, an anti-acne product, an after-sun product, a concealer of spots under the eyes, a concealer of wrinkles under the eyes, a deodorant and a care product for application around the eyes.

33. A device according to claim 1, wherein the first and second parts are assembled together in a leaktight manner.

34. A device according to claim 1, wherein the substance comprises at least two immiscible phases, the substance being capable of being made uniform by turning the second part relative to the first part.

35. A device for packaging and applying a substance, the device comprising:

a receptacle for containing the substance, the receptacle comprising a first part and a second part, the second part being capable of being made uniform by turning the second part relative to the first part; and an applicator;

the second part comprising a protrusion extending into the substance inside the receptacle, said protrusion being a blade and defining two opposite rotary surfaces, at least one of the two rotary surfaces in contact with the substance inside the receptacle and having a shape that is curved in such a matter as to deflect the substance toward the center of the receptacle when said blade is turned in an appropriate direction, and the second part including a bottom edge that matches substantially a shape of a bottom wall of the receptacle and a radially inner edge of the blade being situated in a central region of an inside space of the receptacle for containing the substance, the applicator and at least one of the two rotary surfaces being arranged in such a manner that turning said at least one of the two rotary surfaces exerts pressure on the substance causing substance to move toward the applicator, and the at least one of the two rotary surfaces being configured in such a manner that on being turned said surface moves substance toward a center of the receptacle, the turning of said at least one of the two rotary surfaces being enabled regardless of a position of the applicator with respect to the receptacle, including when the device is in a closed position.

* * * * *